US008253663B2

(12) United States Patent
Taneda et al.

(10) Patent No.: US 8,253,663 B2
(45) Date of Patent: Aug. 28, 2012

(54) DISPLAY APPARATUS, DISPLAY-APPARATUS DRIVING METHOD AND ELECTRONIC EQUIPMENT

(75) Inventors: Takayuki Taneda, Kanagawa (JP); Tetsuro Yamamoto, Kanagawa (JP); Yukihito Iida, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1197 days.

(21) Appl. No.: 12/076,473

(22) Filed: Mar. 19, 2008

(65) Prior Publication Data

US 2008/0238901 A1 Oct. 2, 2008

(30) Foreign Application Priority Data

Mar. 26, 2007 (JP) ..... 2007-079037

(51) Int. Cl.
*G09G 3/12* (2006.01)

(52) U.S. Cl. ..... 345/78; 345/76; 345/79; 345/82; 345/84; 345/204; 315/169.3

(58) Field of Classification Search ..... 345/76, 345/77–80, 82–83, 36, 89, 204, 84; 315/169.3, 315/169.1; 340/815.45
See application file for complete search history.

(56) References Cited

U.S. PATENT DOCUMENTS

2007/0115225 A1* 5/2007 Uchino et al. ..... 345/76

FOREIGN PATENT DOCUMENTS

| | | |
|---|---|---|
| JP | 2002-215096 | 7/2002 |
| JP | 2006-133542 A | 5/2006 |
| JP | 2008-122632 | 5/2008 |

OTHER PUBLICATIONS

Japanese Office Action issued Mar. 17, 2009 for corresponding Japanese Application No. 2007-079037.

* cited by examiner

*Primary Examiner* — Lun-Yi Lao
*Assistant Examiner* — Olga Merkoulova
(74) *Attorney, Agent, or Firm* — Rader, Fishman & Grauer PLLC

(57) ABSTRACT

A display apparatus and display driving method. A selective scan operation is performed on pixel circuits in row units, and a threshold-voltage correction operation is also performed to correct variations of the threshold voltage of respective pixel circuit driving transistors. Before performing the threshold-voltage correction operation in a horizontal scan period, a preparatory operation is performed in order to fix each of the electric potentials appearing on the gate and the source of the driving transistor at a predetermined level.

12 Claims, 14 Drawing Sheets

FIG. 10A WITHOUT THRESHOLD-VOLTAGE CORRECTION AND MOBILITY CORRECTION
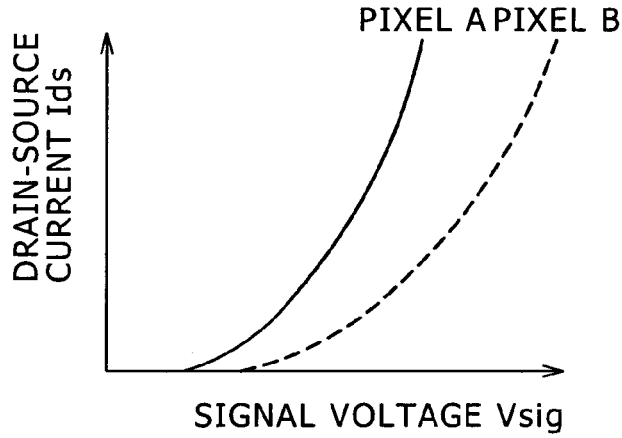
FIG. 10B WITH THRESHOLD-VOLTAGE CORRECTION BUT WITHOUT MOBILITY CORRECTION
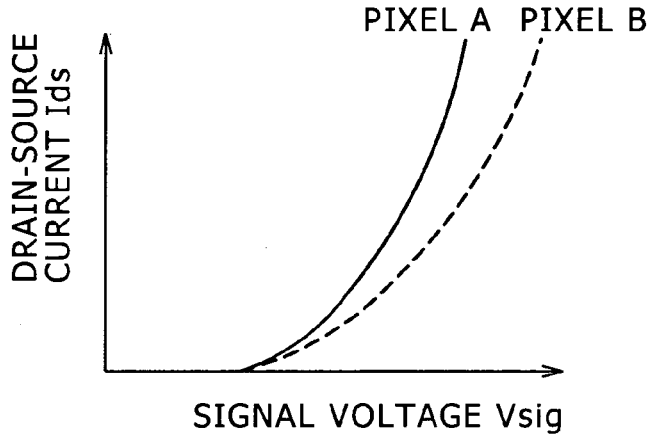
FIG. 10C WITH THRESHOLD-VOLTAGE CORRECTION AND MOBILITY CORRECTION
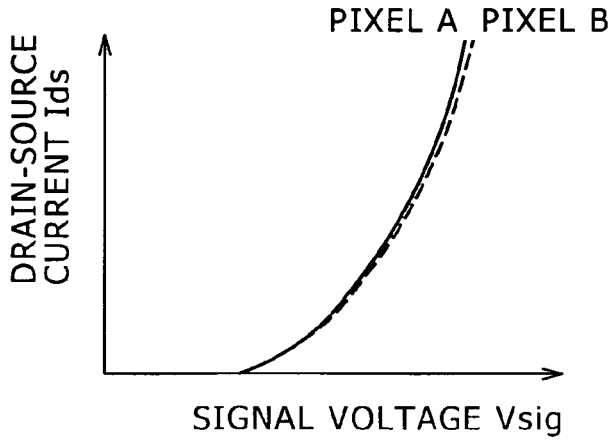

DISPLAY APPARATUS, DISPLAY-APPARATUS DRIVING METHOD AND ELECTRONIC EQUIPMENT

CROSS REFERENCES TO RELATED APPLICATIONS

The present invention contains subject matter related to Japanese Patent Application JP 2007-079037 filed in the Japan Patent Office on Mar. 26, 2007, the entire contents of which being incorporated herein by reference.

BACKGROUND OF THE INVENTION

1. Field of the Invention

The present invention relates to a display apparatus, a method for driving the display apparatus and electronic equipment. More particularly, the present invention relates to a display apparatus of a flat-panel type, in which pixel circuits each including an electro-optical device are laid out to form a matrix, a method for driving the display apparatus and electronic equipment employing the display apparatus.

2. Description of the Related Art

In recent years, in the field of a display apparatus for displaying an image, a display apparatus of a flat-panel type, in which pixels (or pixel circuits) each including a light emitting device are laid out to form a matrix, has been becoming popular very fast. A light emitting device included in each pixel circuit in the display apparatus of a flat-panel type is an electro-optical device of the so-called current-driven type in which the luminance of a light beam emitted by the device changes in accordance with the magnitude of a current flowing through the device. The development of an organic EL (Electro Luminescence) display apparatus employing such electro-optical devices into a commercial product has been making progress. An example of the electro-optical device of the so-called current-driven type is an organic EL device operating on the basis of a phenomenon in which a light beam is generated by the device when an electric field is applied to an organic film.

The organic EL display apparatus has the following characteristics. The organic EL device employed in the EL display apparatus can be driven by an applied voltage not exceeding 10V so that the power consumption of the device is low. In addition, since the organic EL device is a light emitting device, the organic EL display apparatus is capable of displaying an image which is visible in comparison with a liquid crystal display apparatus for displaying an image by controlling the intensity of a light beam generated by a light source known as a backlight in a liquid crystal cell included in every pixel circuit of the liquid crystal display apparatus. On top of that, the organic EL display apparatus can be made light and thin with ease because the organic EL display apparatus does not need illumination members such as the backlight which is necessary for the liquid crystal display apparatus. Furthermore, the organic EL device has an extremely high speed providing a short response time of the order of several microseconds. Thus, a residual image is not generated in an operation to display a moving image.

Much like the liquid crystal display apparatus, a passive matrix method or an active matrix method can be adopted as a method for driving the organic EL display apparatus. However, even though an organic EL display apparatus adopting the passive matrix method has a simple structure, the apparatus raises problems such as difficulties to implement a large display screen having a high resolution. For the reasons described above, an organic EL display apparatus adopting an active matrix method is developed aggressively. In accordance with this active matrix method, an active device is provided in the same pixel circuit as an electro-optical device. The active device is used for controlling a current flowing through the electro-optical device. An example of the active device is an insulated-gate type field effect transistor which is generally a TFT (thin film transistor).

By the way, the I-V characteristic (that is, the current-voltage characteristic) of an organic EL device is known to deteriorate with the lapse of time in the so-called aging process. In a pixel circuit employing an N-channel TFT for controlling a current flowing through the organic EL device, the organic EL device is connected to the source of the transistor which is referred to hereafter as a driving transistor. Thus, when the I-V characteristic of the organic EL device deteriorates, a voltage Vgs appearing between the gate and source of the driving transistor changes. As a result, the intensity of a light beam generated by the organic EL device also changes as well.

To put it more concretely, an electric potential appearing at the source of the driving transistor is determined by the operating points of the driving transistor and the organic EL device. When the I-V characteristic of the organic EL device deteriorates, the operating points of the driving transistor and the organic EL device change. Thus, the electric potential appearing at the source of the driving transistor also changes even if a voltage applied to the gate of the transistor after the operating points of the driving transistor and the organic EL device change is sustained at the same level as that before the operating points of the driving transistor and the organic EL device change. Accordingly, the voltage Vgs appearing between the gate and source of the driving transistor also changes as well, causing a current flowing through the transistor and a current flowing through the organic EL device to vary. As a result, since the current flowing through the organic EL device varies, the intensity of a light beam generated by the organic EL device also changes as well.

In addition, in the case of a pixel circuit employing a poly-silicon TFT, not only does the I-V characteristic of the organic EL device deteriorate with the lapse of time, but the threshold voltage Vth of the driving transistor and the mobility $\mu$ of a semiconductor film composing the channel of the transistor also change with the lapse of time. In the following description, the mobility $\mu$ of a semiconductor film composing the channel of a driving transistor is referred to as the mobility $\mu$ of the driving transistor. On top of that, the threshold voltage Vth and mobility $\mu$ of the driving transistor each vary from pixel to pixel due to variations in fabrication process. That is to say, the characteristic of the driving transistor varies from pixel to pixel.

If the threshold voltage Vth and mobility $\mu$ of the driving transistor each vary from pixel to pixel, the current flowing through the transistor also varies from pixel-to-pixel. Thus, the luminance of a light beam generated by the organic EL device also varies from pixel to pixel even for the same voltage applied to the gate of each driving transistor. As a result, the screen loses uniformity.

In order to prevent the luminance of a light beam generated by the organic EL device from varying from pixel to pixel even for the same voltage applied to the gate of each driving transistor and, hence, from being affected by deteriorations of the I-V characteristic of the organic EL device and/or changes of the threshold voltage Vth and mobility $\mu$ of the driving transistor even if the I-V characteristic deteriorates with the lapse of time and/or the threshold voltage Vth and the mobility $\mu$ change with the lapse of time, it is necessary to provide every pixel circuit with a compensation function and a variety of correction functions as is described in documents such as patent reference 1 which is Japanese Patent Laid-open No. 2006-133542. The compensation function is a function to compensate for characteristic variations of the organic EL device. The correction functions include a threshold-voltage correction function and a mobility correction function. The threshold-voltage correction function is a function to make corrections for threshold voltage (Vth) variations of the driving transistor. On the other hand, the mobility correction function is a function to make corrections for mobility (μ) variations of the driving transistor.

As described above, every pixel circuit is provided with the compensation function to compensate for characteristic variations of the organic EL device, the threshold-voltage correction function to make corrections for threshold voltage (Vth) variations of the driving transistor and the mobility correction function to make corrections for mobility (μ) variations of the driving transistor. Thus, it is possible to prevent the luminance of a light beam generated by the organic EL device from varying from pixel to pixel even for the same voltage applied to the gate of each driving transistor and, hence, from being affected by deteriorations of the I-V characteristic of the organic EL device and/or changes of the threshold voltage Vth and mobility μ of the driving transistor even if the I-V characteristic deteriorates with the lapse of time and/or the threshold voltage Vth and the mobility μ change with the lapse of time.

SUMMARY OF THE INVENTION

As described above, in an organic EL display apparatus with a configuration including pixel circuits each having correction functions such as the threshold-voltage correction function and the mobility correction function, four operations are, carried out periodically on every pixel row. The four operations are: a threshold-voltage correction preparatory operation carried out in order to fix each of the electric potential Vg appearing on the gate of the driving transistor and the electric potential Vs appearing on the source of the driving transistor at a predetermined level; a threshold-voltage correction operation carried out in order to sufficiently raise the electric potential Vs appearing on the source of the driving transistor so as to fix a voltage Vgs appearing between the gate and source of the driving transistor at the threshold voltage Vth of the driving transistor; a signal write operation carried out in order to write an input signal voltage Vsig determined by luminance information as the voltage of a video signal into the pixel circuit; and a mobility correction operation carried out in order to make corrections for the mobility μ of the driving transistor. Details of each of the above operations will be described alter.

If the four operations described above are carried out on each pixel row within a 1H period (where 1H is the length of a horizontal scan period or the length of a horizontal synchronization period), there is a problem of difficulty to allocate sufficient time to each of the threshold-voltage correction operation and the mobility correction operation as a threshold-voltage correction period and a mobility correction period respectively so as to assure that the threshold-voltage correction operation and the mobility correction operation can be carried out with a high degree of reliability. In particular, in an effort to increase the display resolution of the display apparatus, the number of pixel circuits shows a trend of increasing from year to year, inevitably reducing the length of the 1H period. Thus, in the present state of the art, it is difficult to allocate sufficient time to each of the threshold-voltage correction operation and the mobility correction operation as a threshold-voltage correction period and a mobility correction period respectively.

As an example, the above description takes an organic EL display apparatus with a configuration including pixel circuits each having correction functions such as the threshold-voltage correction function and the mobility correction function. It is to be noted, however, that an organic EL display apparatus with a configuration including pixel circuits each having only the threshold-voltage correction function also raises the problem of difficulty to allocate sufficient time to the threshold-voltage correction operation as a threshold-voltage correction period as is the case with the organic EL display apparatus with a configuration including pixel circuits each having both the threshold-voltage correction function and the mobility correction function.

If it is not achieved to allocate sufficient time to each of the threshold-voltage correction operation and the mobility correction operation as a threshold-voltage correction period and a mobility correction period respectively, it is also not achieved to assure that the threshold-voltage correction operation and the mobility correction operation can be carried out with a high degree of reliability. Thus, even if a uniform voltage is applied to the gates of driving transistors, uniformity of the screen is lost due to variations of the luminance of a light beam generated by the organic EL device from pixel to pixel.

In order to solve the problems described above, inventors of the present invention have innovated a display apparatus capable of allocating sufficient time to each of the threshold-voltage correction operation and the mobility correction operation as a threshold-voltage correction period and a mobility correction period respectively so as to assure that the threshold-voltage correction operation and the mobility correction operation can be carried out with a high degree of reliability. In addition, the inventors have also innovated a driving method for the display apparatus and electronic equipment employing the display apparatus.

In accordance with the embodiment of the present invention for solving the problems described above, there is provided a display apparatus employing: a pixel array section including pixel circuits laid out to form a matrix as pixel circuits each having an electro-optical device, a write transistor for carrying out a voltage storing process to sample a video signal and store the sampled video signal into the pixel circuit, a holding capacitor for holding the sampled video signal stored in the pixel circuit by the write transistor, and a driving transistor for driving the electro-optical device on the basis of the video signal held by the voltage holding capacitor. The display apparatus further includes a driving circuit for carrying out a selective scan operation on the pixel circuits in the pixel array section in row units, and a threshold-voltage correction operation to correct variations of the threshold voltage of every driving transistor for each pixel row selected in the selective scan operation. In the display apparatus, before the driving circuit carries out a threshold-voltage correction operation on the pixel row in a horizontal scan period, the driving circuit performs a preparatory operation on the pixel row prior to the horizontal scan period in order to fix each of an electric potential appearing on the gate of the driving transistor and an electric potential appearing on the source of the driving transistor at a predetermined level.

In the display apparatus having the configuration described above as well as electronic equipment employing the display apparatus, as explained above, before a threshold-voltage correction operation is carried out on the pixel row in a horizontal scan period, a preparatory operation is carried out on the pixel row prior to the horizontal scan period in order to fix each of an electric potential appearing on the gate of the driving transistor and an electric potential appearing on the source of the driving transistor at a predetermined level. Thus, it is no longer necessary to allocate sufficient time of the horizontal scan period provided for the pixel row subjected to the threshold-voltage correction operation to the threshold-voltage correction preparatory operation as a threshold-voltage correction preparation period. Therefore, the threshold-voltage correction period set in the horizontal scan period can be prolonged by the threshold-voltage correction preparation period. As a result, it is possible to allocate sufficient time to the threshold-voltage correction operation as a threshold-voltage correction period so as to assure that the threshold-voltage correction operation can be carried out with a high degree of reliability.

In accordance with the embodiment of the present invention, it is possible to allocate sufficient time to the threshold-voltage correction operation as a threshold-voltage correction period so as to assure that the threshold-voltage correction operation in order to suppress variations of the characteristics of the driving transistor and deteriorations of the electro-optical device with the lapse of time can be carried out with a high degree of reliability. Thus, an image having a high quality can be displayed.

BRIEF DESCRIPTION OF THE DRAWINGS

FIGS. 10A to 10C are diagrams showing curves each representing a relation between the input signal voltage Vsig representing a video signal and the drain-source current Ids flowing through a driving transistor to be referred to in description of effects of threshold-voltage and mobility correction processes;

DETAILED DESCRIPTION OF THE PREFERRED EMBODIMENTS

Preferred embodiments of the present invention are described in detail by referring to diagrams as follows.

Figure 1:
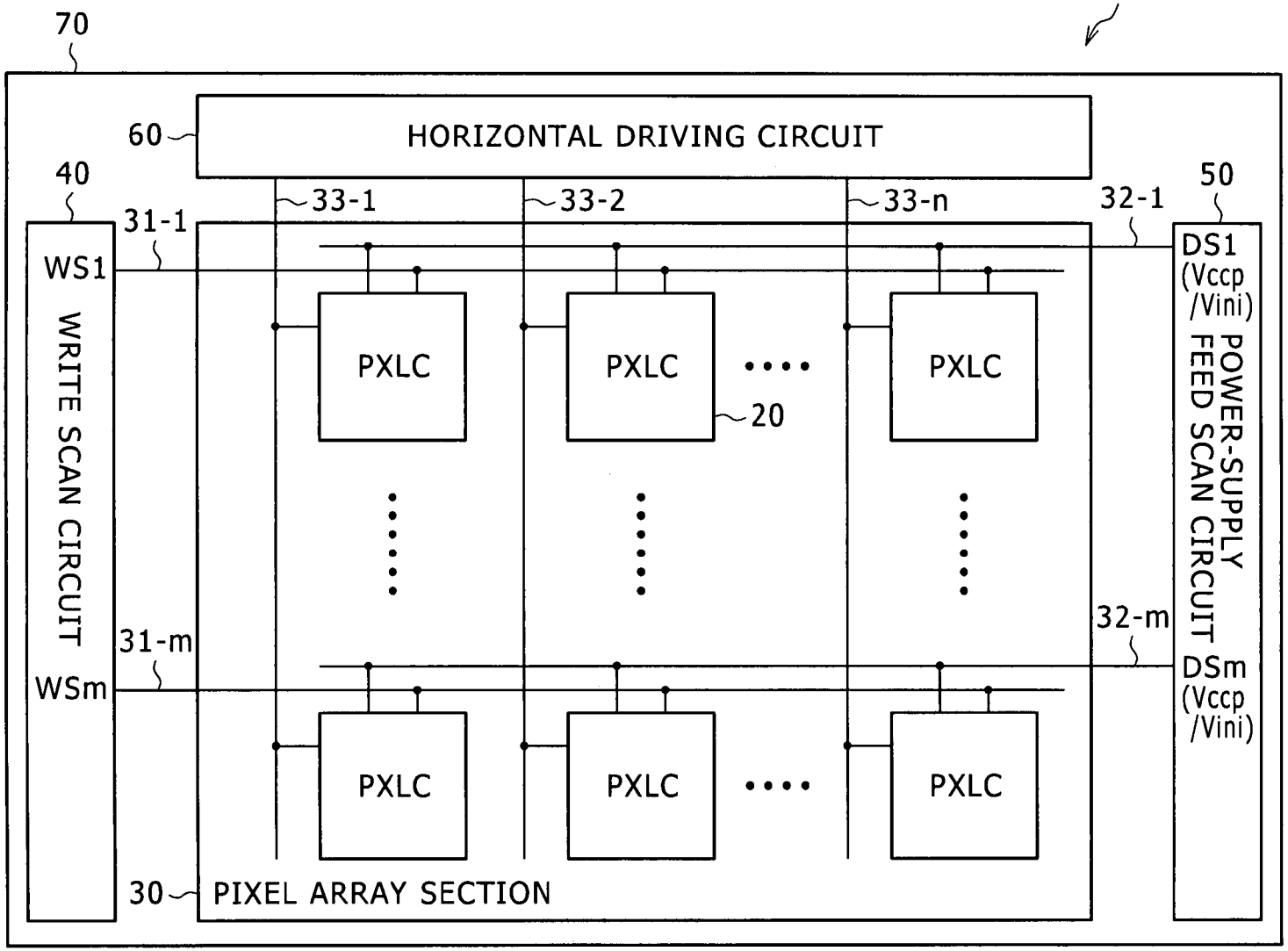
FIG. 1 is a system configuration diagram roughly showing the configuration of an organic EL display apparatus according to an embodiment of the present invention.

FIG. 1 is a system configuration diagram roughly showing the configuration of an active-matrix display apparatus according to an embodiment of the present invention. This typical configuration includes current-driven electro-optical devices each generating a light beam with the luminance thereof determined by a current flowing through the device. That is to say, the typical active-matrix display apparatus is an active-matrix organic EL display apparatus 10 employing light emitting devices each serving as the electro-optical device. An example of the light emitting device employed as the electro-optical device is an organic EL device.

As shown in FIG. 1, the organic EL display apparatus 10 according to the embodiment employs a pixel array section 30 including pixel circuits (PXLC) 20 laid out two-dimensionally to form a matrix and a driving section placed in the peripheries of the pixel array section 30 as a section for driving the pixel circuits 20. The driving section typically has a write scan circuit 40, a power-supply feed line scan circuit 50 and a horizontal driving circuit 60.

The pixel circuits 20 in the pixel array section 30 form a matrix of m rows and n columns. The m rows are connected to m scan lines 31-1 to **31-*m* respectively as well as m power-supply feed lines 32-1 to 32-*m* respectively. On the other hand, the n columns are connected to n signal lines 33-1 to 33-*n*** respectively.

The pixel array section 30 is normally created on a transparent insulation substrate such as a glass substrate and has a panel (flat) structure. Each of the pixel circuits can be created by making use of an amorphous silicon TFT (Thin Film Transistor) or a low-temperature poly-silicon TFT. If a low-temperature poly-silicon TFT is used, the write scan circuit 40, the power-supply feed line scan circuit 50 and the horizontal driving circuit 60 are also created on a display panel (substrate) 70 on which the pixel array section 30 is created.

The write scan circuit 40 typically employs a shift register for shifting (transferring) start pulses sp synchronously with clock pulses ck. In order to carry out an operation to write a video signal into the pixel circuits 20 of the pixel array section 30, the write scan circuit 40 supplies sequential scan signals WS1 to WSm to the scan lines 31-1 to **31-*m* respectively in order to sequentially scan the pixel circuits 20** in row units in the so-called row sequential scan operation.

The power-supply feed line scan circuit 50 also typically employs, a shift register for shifting (transferring) start pulses sp synchronously with clock pulses ck. The power-supply feed line scan circuit 50 supplies power-supply feed-line electric potentials, DS1 to DSm to the power-supply feed lines 32-1 to **32-*m* respectively in synchronization with the row sequential scan operation carried out by the write scan circuit 40. The power-supply feed-line electric potentials DS1** to DSm are each switched to a high first electric potential Vccp from a low second electric potential Vini lower than the high first electric potential Vccp.

The horizontal driving circuit 60 properly selects the voltage Vsig representing a video signal or an offset voltage Vofs. The voltage Vsig representing a video signal varies in accordance with luminance information supplied by a signal supplying source (not shown in the figure). The horizontal driving circuit 60 then simultaneously supplies the selected voltage Vsig or Vofs to the pixel circuits 20 of the pixel array section 30 through signal lines 33-1 to **33-*n* typically in column units. That is to say, the horizontal driving circuit 60** supplies the input signal voltage Vsig (or the offset voltage Vofs) to all pixel circuits on a column simultaneously in the so-called write-line sequential write driving operation.

The offset voltage Vofs is a voltage serving as a reference of the voltage Vsig representing a video signal. Typically, the reference of the voltage Vsig representing a video signal corresponds to the black level of the video signal. In the following description, the voltage Vsig representing a video signal is also referred to as an input signal voltage Vsig or merely a signal voltage Vsig. In addition, the low second electric potential Vini is an electric potential sufficiently lower than the offset voltage Vofs.

(Pixel Circuits)

Figure 2:
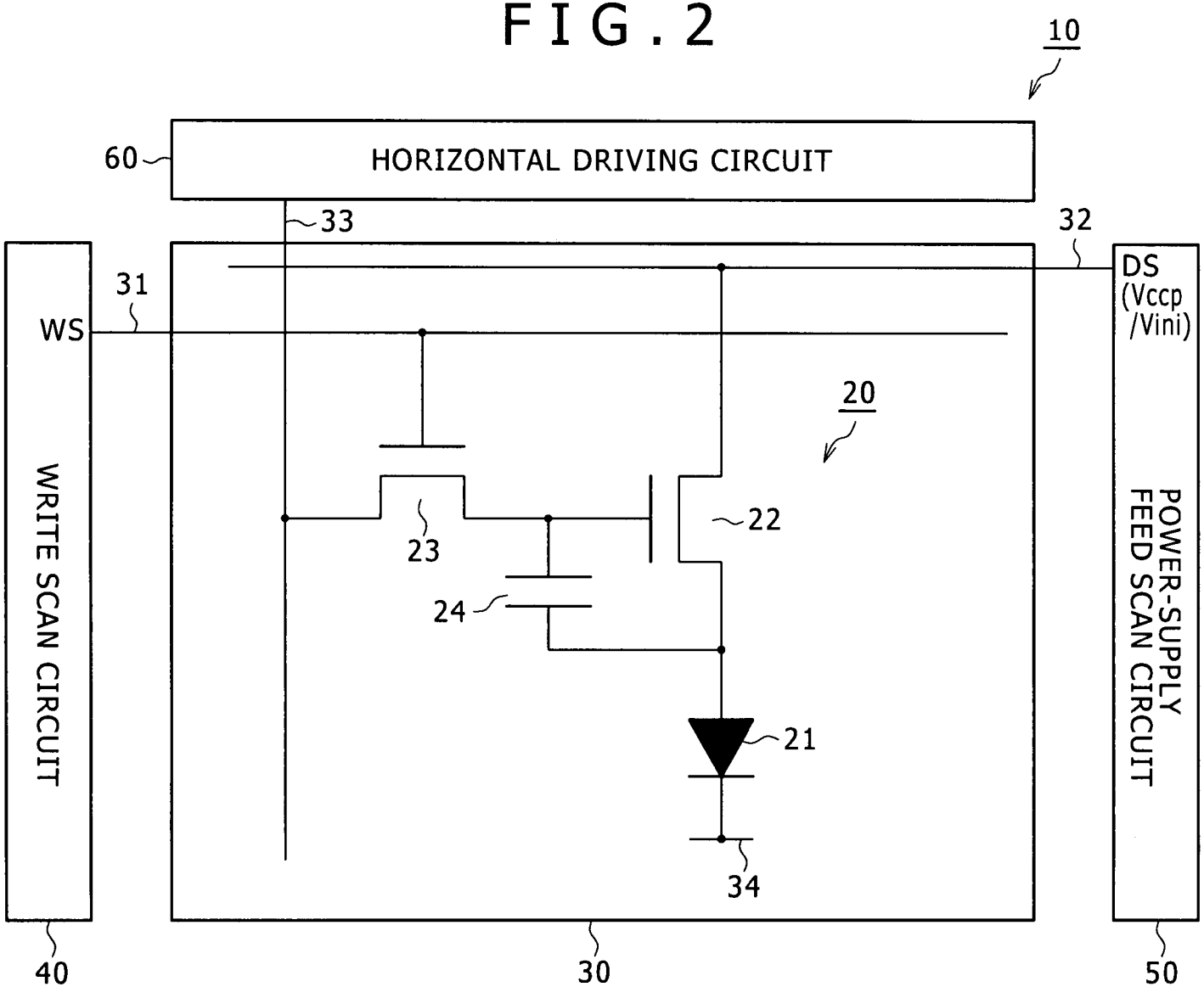
FIG. 2 is a circuit diagram showing a typical concrete configuration of a pixel (or a pixel circuit) employed in the organic EL display apparatus.

FIG. 2 is a circuit diagram showing a typical concrete configuration of a pixel (or a pixel circuit) 20. As shown in FIG. 2, the pixel circuit 20 employs an organic EL device 21 as a current-driven electro-optical device for generating a light beam with the luminance thereof determined by a current flowing through the device. In addition to the organic EL device 21, the pixel circuit 20 also employs a driving transistor 22, a write transistor 23, and a voltage holding capacitor 24.

In the above circuit, the driving transistor 22 and the write transistor 23 are each an N-channel TFT. However, the N-channel conduction type of the driving transistor 22 and the write transistor 23 is no more than a typical one. That is to say, the conduction type of the driving transistor 22 and the write transistor 23 is by no means limited to the N-channel conduction type.

The cathode of the organic EL device 21 is connected to a common power-supply feed line 34 which is connected to all pixel circuits 20. The source of the driving transistor 22 is connected to the anode of the organic EL device 21 and the drain of the driving transistor 22 is connected to a power-supply feed line 32 (or, to be more specific, the corresponding one of the power-supply feed lines 32-1 to **32-*m***).

The gate of the write transistor 23 is connected to a scan line 31 (or, to be more specific, the corresponding one of the scan lines 31-1 to **31-*m*). One of the source and drain of the write transistor 23 is connected to a signal line 33 (or, to be more specific, the corresponding one of the signal lines 33-1 to 33-*n*) whereas the other one of the source and drain of the write transistor 23 is connected to the gate of the driving transistor 22. One terminal of the voltage holding capacitor 24 is also connected to the gate of the driving transistor 22 whereas the other terminal of the voltage holding capacitor 24 is connected to the source of the driving transistor 22 as well as the anode of the organic EL device 21**.

In the pixel circuit 20 with a configuration described above, when a scan signal WS generated by the write scan circuit 40 is applied to the gate of the write transistor 23 through a scan line 31, the write transistor 23 enters a conductive state. In this conductive state, the write transistor 23 samples the signal voltage (input signal voltage) Vsig supplied by the horizontal driving circuit 60 through a signal line 33 as a video-signal voltage representing the luminance of a light beam or samples the offset voltage Vofs also supplied by the horizontal driving circuit 60 through the signal line 33 and writes the sampled voltage in the pixel circuit 20. To put it concretely, the write transistor 23 holds the sampled input signal voltage Vsig or the sampled offset voltage Vofs in the voltage holding capacitor 24.

With the electric potential DS of the power-supply feed line 32 (or, to be more specific, the corresponding one of the power-supply feed lines 32-1 to **32-*m*) set at the high first electric potential Vccp, the driving transistor 22 receives a current from the power-supply feed line 32 and supplies the current to the organic EL device 21 as a driving current for driving the organic EL device 21. The magnitude of the driving current is determined by the input signal voltage Vsig held in the voltage holding capacitor 24**.

(Pixel-Circuit Structure)

Figure 3:
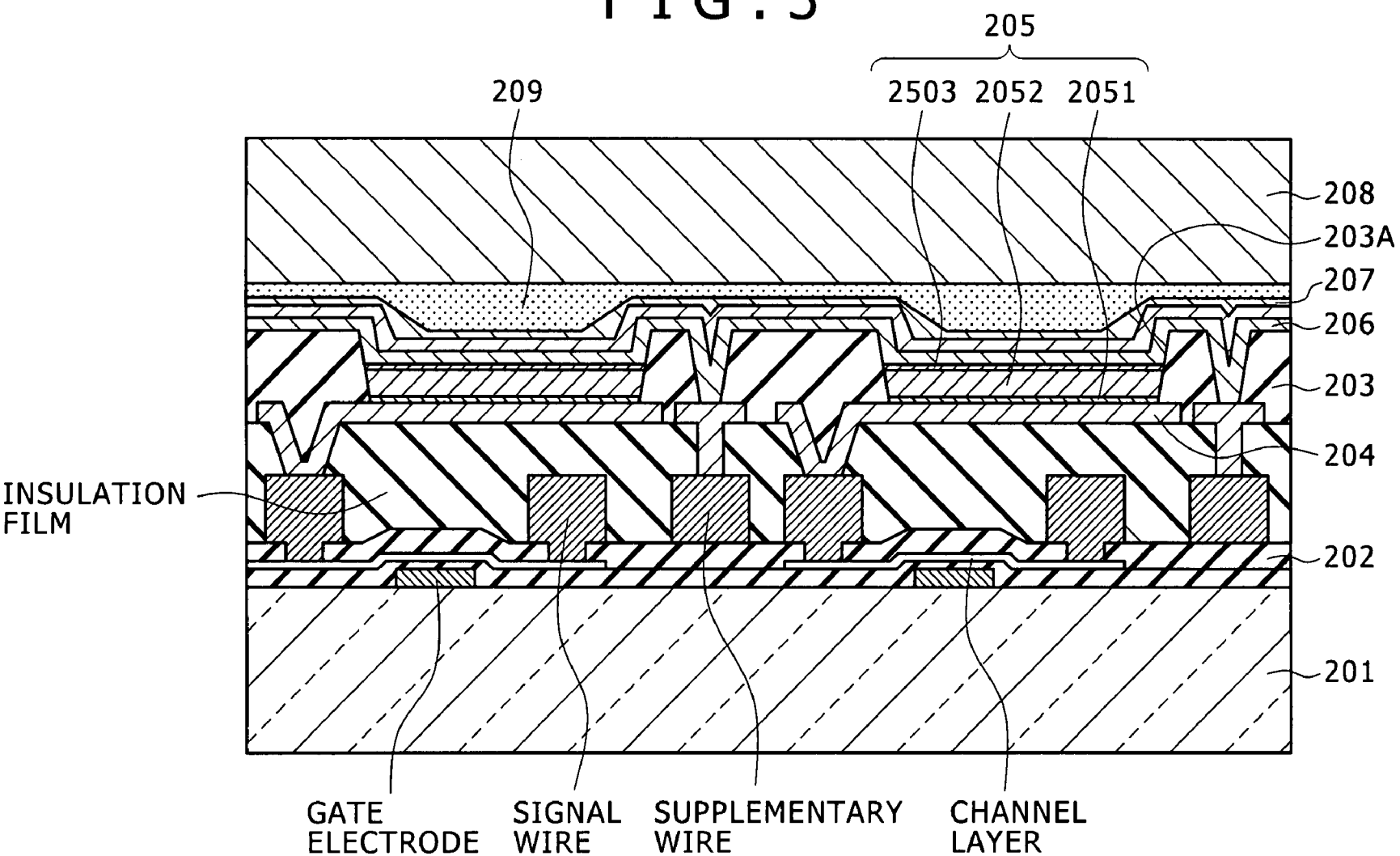
FIG. 3 is a diagram showing a typical cross-sectional structure of the pixel circuit.

FIG. 3 is a diagram showing a typical cross-sectional structure of the pixel circuit 20. As shown in FIG. 3, the pixel circuit 20 is built into a configuration obtained by constructing an insulation film 202 and a wind insulation film 203 over a glass substrate 201 on which a pixel circuit 20 including a driving transistor 22 and a write transistor 23 has been created. The organic EL device 21 is provided in a dent 203A in the wind insulation film 203.

The organic EL device 21 has an anode electrode 204, an organic layer 205 and a cathode electrode 206. The anode electrode 204 is made of materials including a metal created on the bottom of the dent 203A of the wind insulation film 203. Created on the anode electrode 204, the organic layer 205 includes an electron transport layer 2053, a light emitting layer 2052 and a hole transport layer/hole injection layer 2051. Created on the organic layer 205, the cathode electrode 206 is made of materials including a transparent conductive film common to all pixel circuits 20.

The organic layer 205 of the organic EL device 21 is created by sequentially piling the hole transport layer/hole injection layer 2051, the light emitting layer 2052, the electron transport layer 2053 and an electron injection layer not shown in the figure to form a stacked pile of layers on the anode electrode 204. A current generated by the driving transistor 22 shown in FIG. 2 as a driving current flows from the driving transistor 22 to the organic layer 205 through the anode electrode 204. As a result, the light emitting layer 2052 of the organic layer 205 generates light when a hole is recombined with an electron in the light emitting layer 2052.

After an organic EL device 21 is constructed over the glass substrate 201, on which a pixel circuit 20 including a driving transistor 22 and a write transistor 23 have been created, to sandwich the insulation film 202 and the wind insulation film 203 between the organic EL device 21 and the glass-substrate 201 for each pixel circuit 20, a sealing substrate 208 is joined by an adhesive layer 209 to a passivation film 207. In this way, the sealing substrate 208 seals the organic EL device 21 to finally give a display panel 70.

(Threshold-Voltage Correction Function)

While the horizontal driving circuit 60 is supplying the offset voltage Vofs to each of the signal lines 33 (that is, the signal lines 33-1 to **33-*n*) after the write transistor 23 has been put in the conductive state, the power-supply feed line scan circuit 50 switches the electric potential DS asserted thereby on the power-supply feed line 32 to the high first electric potential Vccp from the low second electric potential Vini. By switching the electric potential DS appearing on the power-supply feed line 32 to the high first electric potential Vccp from the low second electric potential Vini, a voltage corresponding to the threshold voltage Vth of the driving transistor 22 is held in the voltage holding capacitor 24**.

The voltage corresponding to the threshold voltage Vth of the driving transistor 22 needs to be held in the voltage holding capacitor 24 because of a reason described as follows. The characteristics of the driving transistor 22 vary from pixel to pixel due to variations of the process to fabricate the driving transistor 22 and due to characteristic changes with the lapse of time. The characteristics of the driving transistor 22 include the threshold voltage Vth and the mobility μ. The variations in transistor characteristics cause the driving current Ids flowing between the drain and source of the driving transistor 22 to vary from pixel to pixel even if the same electric potential is applied to the gates of the driving transistors 22 of the pixel circuits 20. Thus, the luminance of a light beam generated by the organic EL device 21 also varies from pixel to pixel. In order to cancel (or correct) effects of the variations of the threshold voltage Vth from pixel to pixel, a voltage corresponding to the threshold voltage Vth of the driving transistor 22 needs to be held in the voltage holding capacitor 24 in advance.

The threshold voltage Vth of the driving transistor 22 is corrected as follows. By storing a voltage corresponding to the threshold voltage Vth in the voltage holding capacitor 24 in advance, the threshold voltage Vth of the driving transistor 22 is cancelled by a voltage, which has been held in advance in the voltage holding capacitor 24 as the voltage corresponding to the threshold voltage Vth, in an operation to drive the driving transistor 22 by later applying the input signal voltage Vsig to the gate of the driving transistor 22 through the write transistor 23. In other words, the threshold voltage Vth of the driving transistor 22 is corrected in advance prior to the operation to drive the driving transistor 22 by applying the input signal voltage Vsig to the gate of the driving transistor 22 through the write transistor 23.

The function to hold a voltage corresponding to the threshold voltage Vth of the driving transistor 22 in the voltage holding capacitor 24 in advance is referred to as a threshold-voltage correction function. By carrying out this threshold-voltage correction function, effects of variations in threshold voltage Vth from pixel to pixel can be eliminated in case the threshold voltage Vth of the driving transistor 22 varies from pixel to pixel due to variations of the process to fabricate the driving transistor 22 and due to transistor-characteristic changes with the lapse of time. Thus, the luminance of a light beam generated by the organic EL device 21 can be sustained at a constant value. The principle of the threshold-voltage correction operation will be described later.

(Mobility Correction Function)

The pixel circuit 20 shown in FIG. 2 is also provided with a mobility correction function in addition to the threshold-voltage correction function described above. The mobility correction function is carried out as follows. While the horizontal driving circuit 60 is supplying the input signal voltage Vsig to each of the signal lines 33 (that is, the signal lines 33-1 to **33-*n*) after the write transistor 23 has been put in the conductive state in response to one of the scan signals WS1 to WSm supplied by the write scan circuit 40 to the scan lines 31-1 to 31-*m* respectively, that is, during a mobility correction period, a mobility correction process is carried out in an operation to hold the input signal voltage Vsig in the voltage holding capacitor 24 as a process to eliminate dependence on the mobility μ of the driving current Ids flowing between the drain and source of the driving transistor 22**. The concrete principle and concrete operation of the mobility correction function will be described later.

(Bootstrap Function)

The pixel circuit 20 shown in FIG. 2 is also provided with a bootstrap function which works as follows. After the input signal voltage Vsig representing a video signal has been held in the holding capacitor 24, the write scan circuit 40 stops the operation to supply the scan signal WS (that is, a corresponding one of the scan signals WS1 to WSm) to the scan line 31 (that is, a corresponding one of the scan lines 31-1 to **31-*m*) in order to put the write transistor 23 in a non-conductive state which electrically disconnects the gate of the driving transistor 22 from the signal line 33 (that is, a corresponding one of the signal lines 33-1 to 33-*n*). Thus, the electric potential Vg appearing on the gate of the driving transistor 22 changes to faithfully follow the electric potential Vs appearing on the source of the driving transistor 22 in an interlocked manner. As a result, a voltage Vgs appearing between the gate and source of the driving transistor 22** can be sustained at a constant level.

That is to say, even if the I-V characteristic of the organic EL device 21 changes with the lapse of time, causing the electric potential Vs appearing on the source of the driving transistor 22 also to vary, the voltage Vgs appearing between the gate and source of the driving transistor 22 is sustained at a constant level by virtue of the operation of the holding capacitor 24. Thus, a driving current flowing through the organic EL device 21 does not change. As a result, the luminance of a light beam generated by the organic EL device 21 can be sustained at a constant value even if the I-V characteristic of the organic EL device 21 changes with the lapse of time. The operation to eliminate fluctuations in luminance is referred to as a bootstrap operation. By virtue of the bootstrap operation, it is possible to display an image with no luminance deteriorations even if the I-V characteristic of the organic EL device 21 changes with the lapse of time.

As is obvious from the above description, the driving circuit is designed into a configuration in which: the write scan circuit 40 and the power-supply feed scan circuit 50 each carry out a selective scan operation on the pixel circuits 20 of the pixel array section 30 in row units; and threshold-voltage correction and mobility correction operations are carried out to correct respectively the threshold voltage Vth and mobility μ of the driving transistor 22 for every selected pixel row in a 1H period.

Characteristics of the Embodiment

As described above, the embodiment implementing the organic EL display apparatus 10 provided with correction functions such as the threshold-voltage correction function and the mobility correction function executes a threshold-voltage correction-preparatory operation and a threshold-voltage correction operation for every pixel row selected in a vertical scan operation in a 1H period, before the threshold-voltage correction operation is carried out on the pixel row in the 1H period, the threshold-voltage correction preparatory operation is carried out on the pixel row prior to the 1H period in order to fix each of an electric potential Vg appearing on the gate of the driving transistor 22 and an electric potential Vs appearing on the source of the driving transistor 22 at a predetermined level. In the following description, a pixel row selected in a vertical scan operation is referred to as a correction-subject pixel row, and 1H is the length of a horizontal scan period or the length of a horizontal synchronization period.

(Circuit Operations Carried Out by the Organic EL Display Apparatus)

Operations carried out by the organic EL display apparatus 10 according to the embodiment are explained by referring to timing charts of FIG. 4 as well as explanatory operation diagrams of FIGS. 5A to 7C as follows. It is to be noted that, in order to make the explanatory operation diagrams of FIGS. 5A to 7C simple, the write transistor 23 is shown as a symbol representing a switch. In addition, a parasitic capacitor Cel of the organic EL device 21 is also shown in the diagrams.

Figure 4:
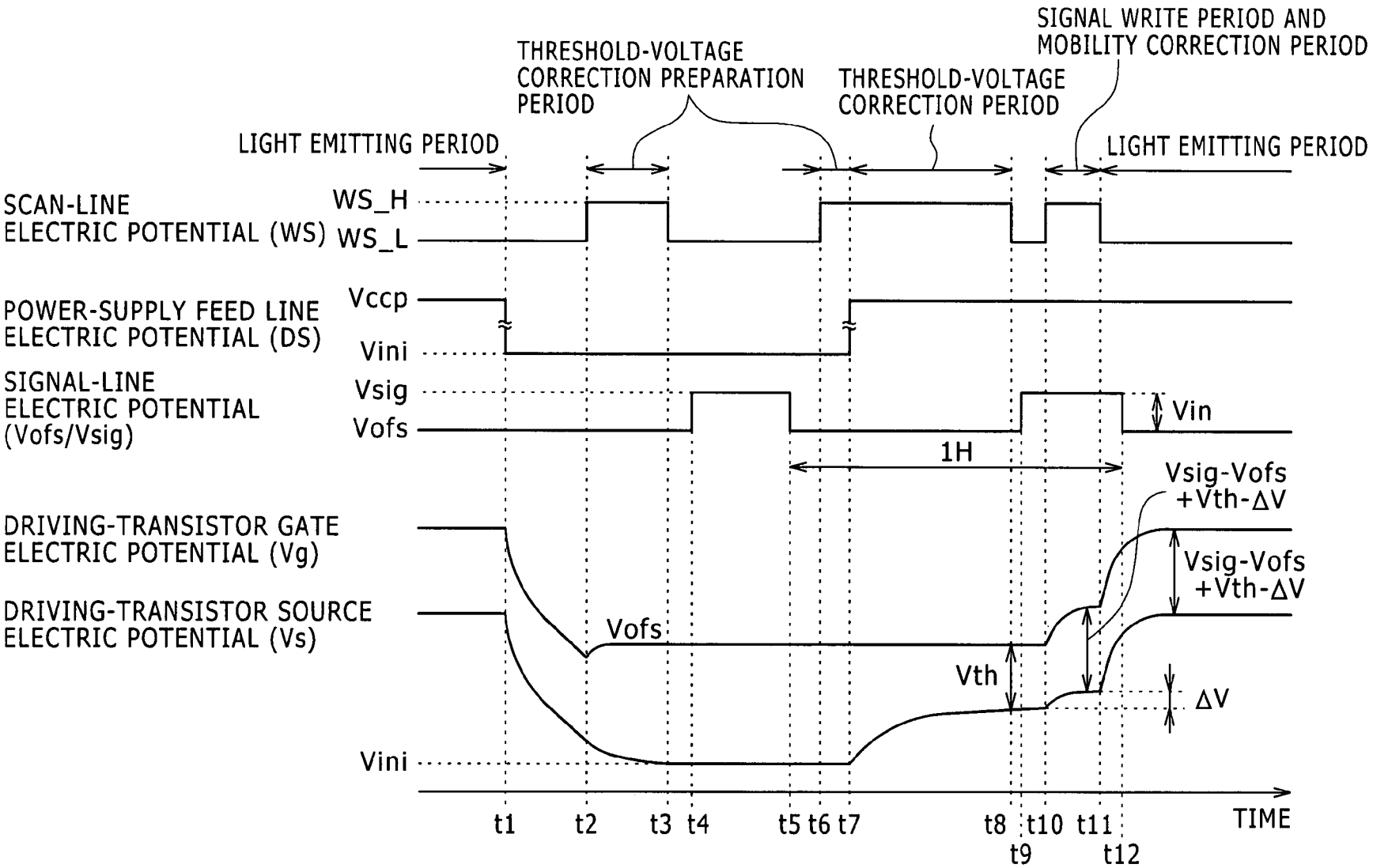
FIG. 4 is an explanatory diagram showing timing charts to be referred to in description of operations carried out by the circuit of the organic EL display apparatus according to the embodiment of the present invention.

In the timing charts shown in FIG. 4, the horizontal axis is a time axis common to the charts. The timing charts show a variety of changes occurring along the time axis. The changes shown in the timing charts are changes of an electric potential representing the scan signal WS appearing on the scan line 31 representing the scan lines 31-1 to **31-*m*, changes of the electric potential DS appearing on the power-supply feed line 32 representing the power-supply feed lines 32-1 to 32-*m*, changes of an electric potential (from Vofs to Vsig and vice versa) appearing on the signal line 33 representing the signal lines 33-1 to 33-*n*, changes of the electric potential Vg appearing on the gate of the driving transistor 22 and changes of the electric potential Vs appearing on the source of the driving transistor 22**, of the correction-subject pixel row.

In the timing charts shown in FIG. 4, a period extended from a time t5 to a time t12 is a 1H period for a correction-subject pixel row. In this 1H period, a threshold-voltage correction operation, an operation for storing an input signal voltage Vsig in the pixel circuit 20 and a mobility correction operation are carried out on the correction-subject pixel row.

It is to be noted that the time t5 is a timing with which the electric potential appearing on the signal line 33 of a pixel row immediately preceding the correction-subject pixel row is changed from the input signal voltage Vsig to the offset voltage Vofs. On the other hand, the time t12 is a timing with which the electric potential appearing on the signal line 33 of the correction-subject pixel row is changed from the input signal voltage Vsig to the offset voltage Vofs.

<Light Emitting Period>

Figure 5A:
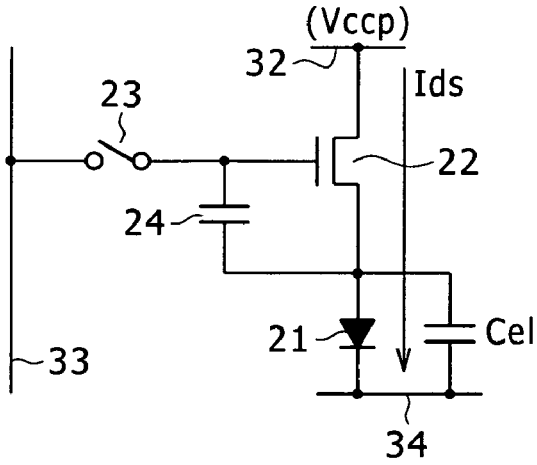
FIGS. 5A to 7C are explanatory diagrams in description of operations carried out by the circuit of the organic EL display apparatus according to the embodiment of the present invention.

In the timing charts shown in FIG. 4, a period ending at a time t1 is referred to as a light emitting period during which the organic EL device 21 is sustained in a state of emitting a light beam. In this light emitting period, the electric potential DS appearing on the power-supply feed line 32 is sustained at the high first electric potential Vccp whereas the write transistor 23 is kept in a non-conductive state. During this period, the driving transistor 22 is set to operate in a saturated region. Thus, a drain-source current Ids is supplied from the power-supply feed line 32 to the organic EL device 21 by way of the driving transistor 22 as shown in FIG. 5A as a driving current with a magnitude determined by the electric potential Vgs appearing between the gate and source of the driving transistor 22. As a result, the organic EL device 21 generates a light beam with the luminance thereof determined by the driving current Ids.

<Threshold-Voltage Correction Preparatory Period>

Figure 5B:
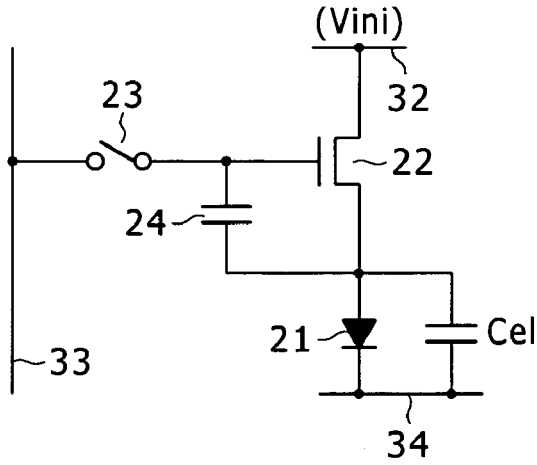

At the time t1, the pixel circuit 20 enters a new field of a row sequential scan process. At this time, the electric potential DS appearing on the power-supply feed line 32 is switched from the high electric potential Vccp to the low second electric potential Vini sufficiently lower than the offset voltage Vofs appearing on the signal line 33 as shown in FIG. 5B. Let symbol Vel denote the threshold voltage of the organic EL device 21 and notation Vcath denote an electric potential appearing on the common power-supply feed line 34. In addition, let us assume that the low second electric potential Vini satisfies a relation of Vini<(Vel+Vcath). In this case, since the electric potential Vs appearing on the source of the driving transistor 22 is approximately equal to the low second electric potential Vini, the organic EL device 21 is put in a reverse bias state.

Figure 5C:
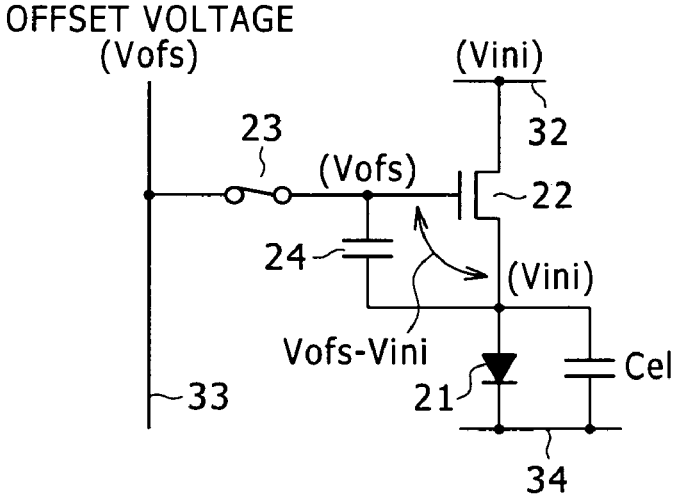

Then, at a time t2, the electric potential WS appearing on the scan line 31 is changed from a low electric potential WS_L to a high electric potential WS_H in order to put the write transistor 23 in a conductive state as shown in FIG. 5C. At that time, since the horizontal driving circuit 60 has supplied the offset voltage Vofs to the signal line 33, the electric potential Vg appearing at the gate of the driving transistor 22 is also set at the offset voltage Vofs as well. In addition, the electric potential Vs appearing on the source of the driving transistor 22 is set at the low second electric potential Vini which is sufficiently lower than the offset voltage Vofs.

Thus, the voltage Vgs appearing between the gate and source of the driving transistor 22 becomes equal to a difference of (Vofs−Vini). If the difference of (Vofs−Vini) is not greater than the threshold voltage Vth of the driving transistor 22, the threshold-voltage correction operation explained earlier cannot be carried out. It is thus necessary to set an electric-potential relation of (Vofs−Vini)>Vth. The operation initialize the electric potential Vg appearing at the gate of the driving transistor 22 by fixing (or to confirmedly setting) the electric potential Vg at the offset voltage Vofs and the operation to initialize the electric potential Vs appearing at the source of the driving transistor 22 by fixing (or to confirmedly setting) the electric potential Vs at the low second electric potential Vini are referred to as a threshold-voltage correction preparatory operation.

Then, at a time t3, the scan signal WS appearing on the scan line 31 is changed from a high electric potential WS_H to a low electric potential WS_L in order to end the threshold-voltage correction preparatory operation. In this way, the threshold-voltage correction preparatory operation is carried out on the correction-subject pixel row prior to a time t4 earlier than the start of the 1H period for the correction-subject pixel row.

Figure 6A:
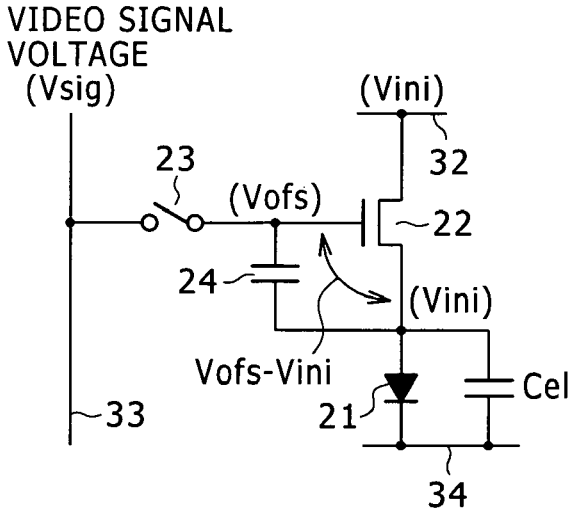

Later on, at a time t4, in order to carry out each of an operation to write the input signal voltage Vsig and a mobility correction operation on a pixel row immediately preceding the correction-subject pixel row, the electric potential appearing on the signal line 33 provided for the immediately preceding pixel row is changed from the offset voltage Vofs to the input signal voltage Vsig. The operation to switch the electric potential appearing on the signal line 33 provided for the immediately preceding pixel row from the offset voltage Vofs to the input signal voltage Vsig is an operation carried out on the pixel row immediately preceding the correction-subject pixel row. Thus, after the time t4, each write transistor 23 on the correction-subject pixel row is sustained in a non-conductive state as shown in FIG. 6A.

Then, at a time t5, the electric potential appearing on the signal line 33 provided for the pixel row immediately preceding the correction-subject pixel row is changed back from the input signal voltage Vsig to the offset voltage Vofs in order to start the 1H period for the correction-subject pixel row.

Figure 6B:
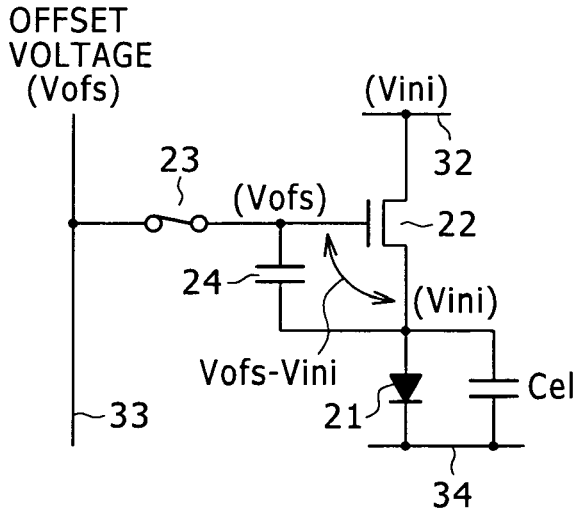

Subsequently, at a time t6, the scan signal WS appearing on the scan line 31 is changed back to a high electric potential WS_H from a low electric potential WS_L in order to put the write transistor 23 in a conductive state as shown in FIG. 6B. Then, during a period extended from the time t6 to a time t7, the scan signal WS appearing on the scan line 31, the electric potential DS appearing on the power-supply feed line 32 and the electric potential appearing on the signal line 33 are sustained in the same respective states as the period extended from the time t2 to the time t3. It is to be noted that, during these periods, the electric potential appearing on the signal line 33 is sustained at the offset voltage Vofs. Thus, the period extended from the time t6 to the time t7 is also a threshold-voltage correction preparation period during which the electric potential Vg appearing on the gate of the driving transistor 22 and the electric potential Vs appearing on the source of the driving transistor 22 are sustained at the offset voltage Vofs and the low second electric potential Vini respectively.

<Threshold-Voltage Correction Period>

Figure 6C:
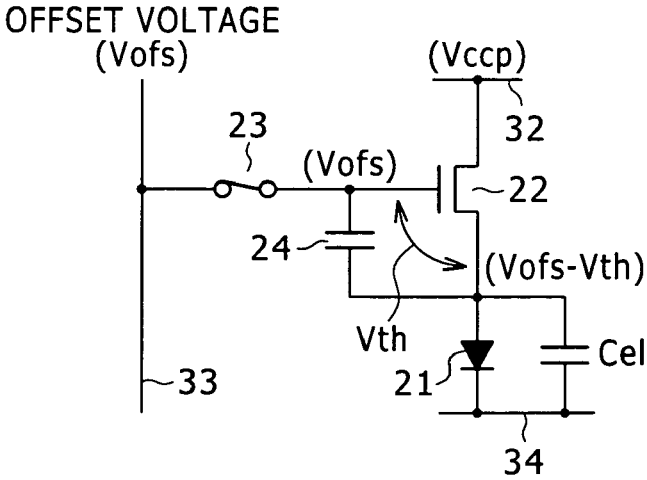

Then, at the time t7, the electric potential DS appearing on the power-supply feed line 32 is changed from the low second electric potential Vini to the high first electric potential Vccp. Since the write transistor 23 is in a conductive state at that time, the electric potential Vs appearing on the source of the driving transistor 22 starts to rise. In due course of time, the electric potential Vs appearing on the source of the driving transistor 22 rises to an electric potential of (Vofs−Vth) as shown in FIG. 6C. At that time, the gate-source voltage Vgs appearing between the gate and source of the driving transistor 22 attains the threshold voltage Vth of the driving transistor 22 and a voltage corresponding to the threshold voltage Vth is thus held in the holding capacitor 24.

Here, for the sake of convenience, a period during which a voltage corresponding to the threshold voltage Vth of the driving transistor 22 is held in the voltage holding capacitor 24 is referred to as a threshold-voltage correction period. It is to be noted that, in order to flow a current exclusively to the voltage holding capacitor 24 and no current to the organic EL device 21 during the threshold-voltage correction period, the organic EL device 21 needs to be put in a cutoff state by setting the common power-supply feed line 34 at the electric potential Vcath.

Figure 7A:
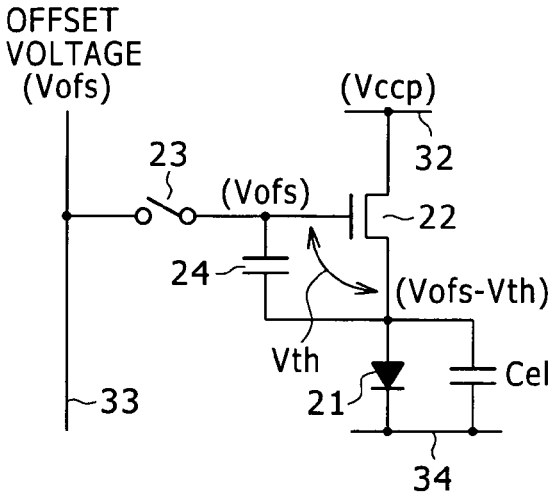

Then, at a time t8, the electric potential WS appearing on the scan line 31 is changed from the high electric potential WS_H to the low electric potential WS_L in order to put the write transistor 23 in a non-conductive state as shown in FIG. 7A. At this time, the gate of the driving transistor 22 is put in a floating state and, since the voltage Vgs appearing between the gate and source of the driving transistor 22 is approximately equal to the threshold voltage Vth of the driving transistor 22, the driving transistor 22 is put in a cutoff state. Thus, the drain-source current Ids does not flow through the driving transistor 22.

<Write Period and Mobility Correction Period>

Figure 7B:
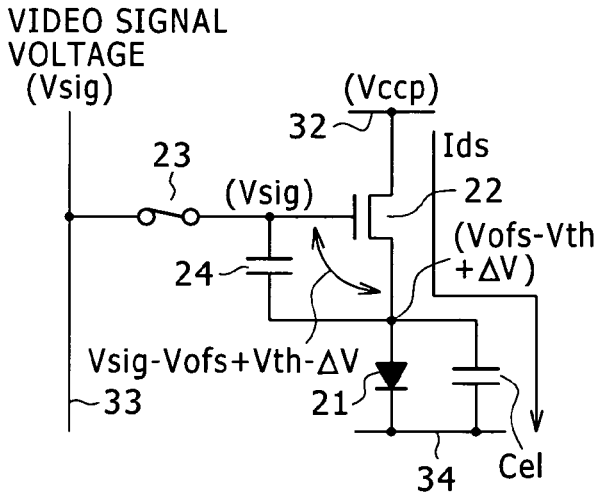

Then, at a time t9, the electric potential appearing on the signal line 33 is changed from the offset voltage Vofs to the input signal voltage Vsig. Subsequently, at a time t10, the scan signal WS appearing on the scan line 31 is changed from the low electric potential WS_L to the high electric potential WS_H in order to put the write transistor 23 in a conductive state as shown in FIG. 7B. In this state, the write transistor 23 samples the input signal voltage Vsig representing a video signal and saves the sampled input signal voltage Vsig in the pixel circuit 20.

In actuality, the write transistor 23 stores the input signal voltage Vsig in the holding capacitor 24 employed in the pixel circuit 20, setting the electric potential Vg appearing on the gate of the driving transistor 22 at the input signal voltage Vsig. Then, in an operation carried out to drive the driving transistor 22 by making use of the input signal voltage Vsig set on the gate of the driving transistor 22, the threshold voltage Vth of the driving transistor 22 is cancelled by the voltage held in advance in the holding capacitor 24 as a voltage corresponding to the threshold voltage Vth of the driving transistor 22, performing a threshold-voltage correction process.

At that time, since the organic EL device 21 is initially in a cutoff (high-impedance) state, a drain-source current Ids flowing from the power supply to the driving transistor 22 in accordance with an input signal voltage Vsig proceeds to the parasite capacitor Cel of the organic EL device 21. That is to say, a process to electrically charge the parasite capacitor Cel is started.

The process to electrically charge the parasite capacitor Cel causes the electric potential Vs appearing on the source of the driving transistor 22 to rise with the lapse of time. At that time, variations of the threshold voltage Vth of the driving transistor 22 have already been corrected. However, the drain-source current Ids flowing through the driving transistor 22 is dependent on the mobility μ of the driving transistor 22.

In due course of time, the electric potential Vs appearing on the source of the driving transistor 22 rises to a level of (Vofs−Vth+ΔV), making the voltage Vgs appearing between the gate and source of the driving transistor 22 equal to (Vsig−Vofs+Vth−ΔV). That is to say, the level of (Vsig−Vofs+Vth−ΔV) at which the voltage Vgs appearing between the gate and source of the driving transistor 22 is set is a result of a negative feedback to subtract the increase ΔV of the electric potential Vs appearing on the source of the driving transistor 22 from a voltage (Vsig−Vofs+Vth) held by the voltage holding capacitor 24. In other words, the negative feedback works to electrically discharge the voltage holding capacitor 24. Thus, the increase ΔV in electric potential Vs is the feedback quantity of the negative feedback.

By feeding back a negative feedback quantity ΔV proportional to the drain-source current Ids flowing through the driving transistor 22 to the gate of the driving transistor 22 as described above, that is, by applying the negative feedback quantity ΔV to the voltage Vgs appearing between the gate and source of the driving transistor 22, the dependence of the drain-source current Ids flowing through the driving transistor 22 on the mobility μ is eliminated. That is to say, a mobility correction operation is carried out to correct the variations of the mobility μ.

To put it more concretely, the higher the input signal voltage Vsig representing the video signal is, the larger the drain-source current Ids flowing through the driving transistor 22 becomes and, hence, the larger the absolute value of the feedback quantity ΔV of the negative feedback becomes. In the following description, the feedback quantity ΔV of the negative feedback is also referred to as a correction quantity ΔV. Thus, the mobility correction operation is carried out in accordance with the level of the luminance of a light beam generated by the organic EL device 21. In addition, with the input signal voltage Vsig of the video signal kept at a constant value, the larger the mobility μ of the driving transistor 22 is, the larger the absolute value of the feedback quantity ΔV of the negative feedback becomes. Thus, variations of the mobility μ from pixel to pixel can be eliminated.

<Light Emitting Period>

Figure 7C:
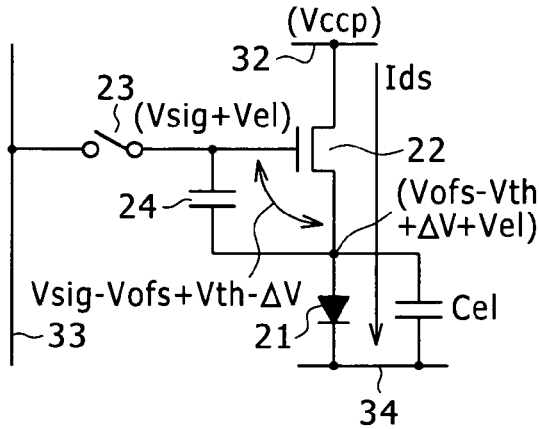

Then, at a time t11, the electric potential WS appearing on the scan line 31 is changed from a high electric potential WS_H to a low electric potential WS_L in order to put the write transistor 23 in a non-conductive state as shown in FIG. 7C. In this state, the gate of the driving transistor 22 is disconnected from the signal line 33. At the same time, the drain-source current Ids starts to flow through the organic EL device 21 so that an electric potential appearing on the anode of the organic EL device 21 rises in accordance with the drain-source current Ids.

The increase of the electric potential appearing on the anode of the organic EL device 21 is no other than an increase of the electric potential Vs appearing on the source of the driving transistor 22. As the electric potential Vs appearing on the source of the driving transistor 22 rises, the electric potential Vg appearing on the gate of the driving transistor 22 also rises as well in an interlocked manner due to a bootstrap operation of the voltage holding capacitor 24. At that time, the increase of the electric potential Vg appearing on the gate of the driving transistor 22 is equal to the increase of the electric potential Vs appearing on the source of the driving transistor 22. Therefore, in a light emitting period, the voltage Vgs appearing between the gate and source of the driving transistor 22 is sustained at the level of (Vsig−Vofs+Vth−ΔV). Then, at a time t12, the electric potential appearing on the signal line 33 changes from the input signal voltage Vsig representing the video signal to the offset voltage Vofs.

(Principle of the Threshold-Voltage Correction)

The principle of an operation to correct the threshold voltage Vth of the driving transistor 22 is explained as follows. Designed to operate in a saturated region, the driving transistor 22 functions as a constant current source. Thus, the driving transistor 22 supplies a driving current Ids to the organic EL device 21. Also referred to hereafter as a drain-source current Ids, the driving current Ids has a fixed magnitude expressed by following Eq. (1).

$$Ids=(1/2)*\mu(W/L)Cox(Vgs-Vth)^2 \quad (1)$$

Notation W denotes the channel width of the driving transistor 22, notation L denotes the channel length of the driving transistor 22 and notation Cox denotes a gate capacity per unit area of the driving transistor 22.

Figure 8:
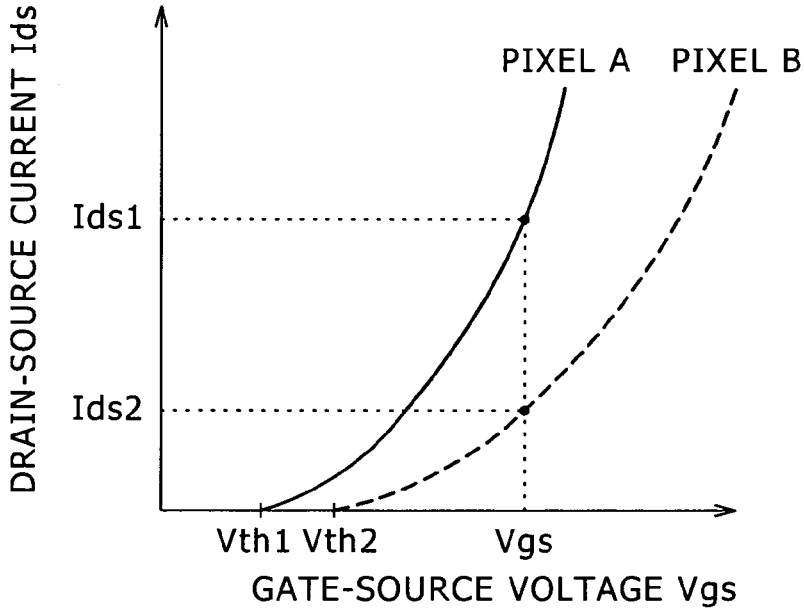
FIG. 8 is an explanatory characteristic diagram to be referred to in description of a problem caused by variations of the threshold voltage Vth of a driving transistor from pixel to pixel.

FIG. 8 is a diagram showing typical characteristic curves each representing a relation between the drain-source current Ids flowing through the driving transistor 22 and the gate-source voltage Vgs, which appears between the gate and source of the driving transistor 22. As described earlier, the threshold voltage Vth of the driving transistor 22 varies from pixel to pixel. In the case of the typical characteristic curves shown by the typical characteristic curves in the figure, the threshold voltage Vth of the driving transistor 22 in pixel circuit A is Vth1 whereas the threshold voltage Vth of the driving transistor 22 in pixel circuit B is Vth2 which is greater than Vth1 (that is, Vth2>Vth1). Thus, if a threshold-voltage correction operation is not carried out, for the same gate-source voltage Vgs appearing between the gate and source of the driving transistor 22, the driving transistor 22 of pixel circuit A generates a drain-source current Ids1 which is greater than a drain-source current Ids2 generated by the driving transistor 22 of pixel circuit B (that is, Ids2<Ids1). That is to say, if the threshold voltage Vth of a driving transistor 22 changes, the drain-source current Ids generated by the driving transistor 22 also changes even if the gate-source voltage Vgs applied between the gate and source of the driving transistor 22 remains the same.

In the case of the pixel (or the pixel circuit) 20 having the configuration described above, on the other hand, the gate-source voltage Vgs appearing between the gate and source of the driving transistor 22 is (Vsig−Vofs+Vth−ΔV) as described above. Inserting (Vsig−Vofs+Vth−ΔV) into Eq. (1) as a substitute for the gate-source voltage Vgs yields the following expression of the drain-source current Ids:

$$Ids=(1/2)*\mu(W/L)Cox(Vsig-Vofs-\Delta V)^2 \quad (2)$$

That is to say, the term of the threshold voltage Vth of the driving transistor 22 is eliminated from Eq. (1) in a process referred to as the threshold-voltage correction operation to result in a drain-source current Ids expressed by Eq. (2). In other words, by virtue of the threshold-voltage correction operation, the drain-source current Ids supplied by the driving transistor 22 to the organic EL device 21 no longer depends on the threshold voltage Vth of the driving transistor 22. Thus, for a given gate-source voltage Vgs appearing between the gate and source, the drain-source current Ids does not change even if the threshold voltage Vth of the driving transistor 22 varies from pixel to pixel due to variations of the process to fabricate the driving transistor 22 and/or due to changes with the lapse of time. As a result, for a given gate-source voltage Vgs appearing between the gate and source, the organic EL device 21 generates a light beam with a luminance that does not vary from pixel to pixel and does not vary with the lapse of time.

(Principle of the Mobility Correction)

Figure 9:
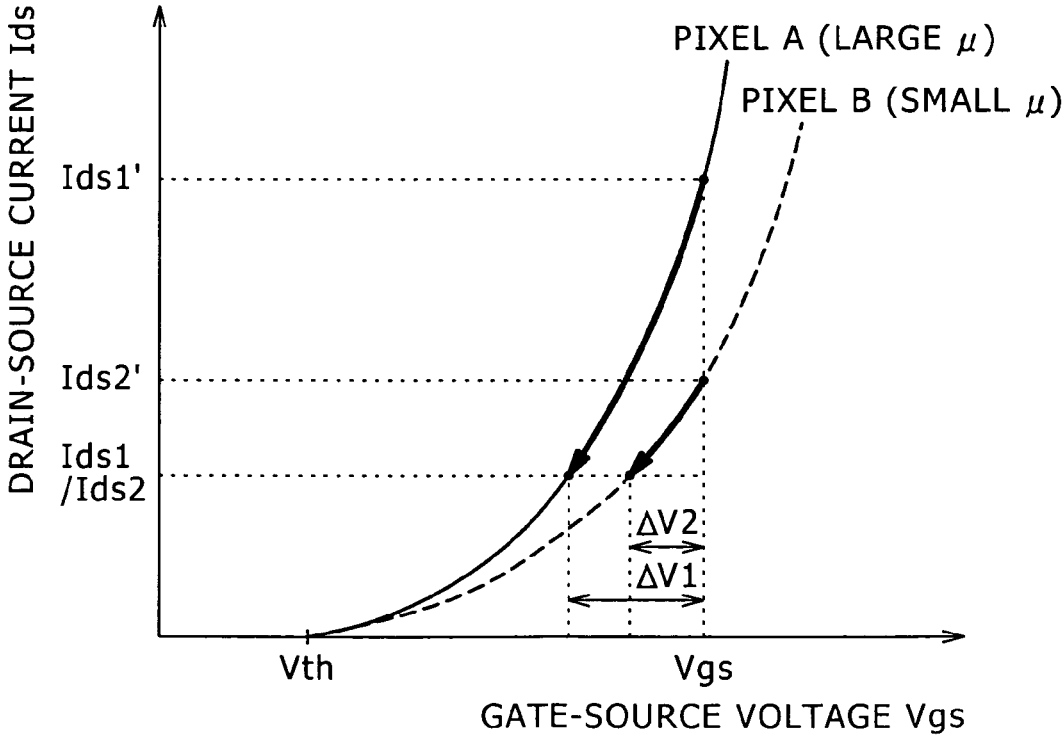
FIG. 9 is an explanatory characteristic diagram to be referred to in description of a problem caused by variations of the mobility μ of a driving transistor from pixel to pixel.

Next, the principle of an operation to correct the mobility of the driving transistor 22 is explained as follows. FIG. 9 is a diagram showing typical characteristic curves each representing a relation between the drain-source current Ids flowing through the driving transistor 22 and the gate-source voltage Vgs, which appears between the gate and source of the driving transistor 22. As described earlier, the mobility μ of the driving transistor 22 varies from pixel to pixel. In the case of the typical characteristic curves shown by the typical characteristic curves in the figure, the mobility μ of the driving transistor 22 in pixel circuit A is greater than the mobility μ of the driving transistor 22 in pixel circuit B. If the driving transistor 22 is a poly-silicon thin film transistor, the pixel-to-pixel mobility variations such as the difference in mobility μ between pixel circuits A and B cannot be avoided.

If there is a difference in mobility μ of the driving transistor 22 between pixel circuits A and B, unless a process to correct the mobility μ in one way or another is carried out, the drain-source current Ids1' flowing through the driving transistor 22 in pixel circuit A having a relatively large mobility μ of the driving transistor 22 is much greater than the drain-source current Ids2' flowing through the driving transistor 22 in pixel circuit B having a relatively small mobility μ of the driving transistor 22 even if input signal voltages Vsig of the same level are applied to pixel circuits A and B. If the drain-source current Ids flowing in a pixel circuit is much different from the drain-source current Ids flowing in another pixel circuit due to mobility (μ) variations from pixel to pixel as described above, pixel-circuit uniformity is lost.

As is obvious from the transistor characteristic equation expressed by Eq. (1) given before, the larger the mobility μ is, the larger the drain-source current Ids becomes. Thus, the larger the mobility μ is, the larger the feedback quantity ΔV of the negative feedback becomes. As shown in FIG. 9, the feedback quantity ΔV1 of pixel circuit A having a driving transistor 22 with relatively large mobility μ is greater than the feedback quantity ΔV2 of pixel circuit B having a driving transistor 22 with a relatively small mobility μ. In a mobility correction process, the drain-source current Ids of the driving transistor 22 is negatively fed back to the side of the input signal voltage Vsig. In this negative feedback, the larger the mobility μ is, the larger the feedback quantity ΔV becomes. Thus, variations in mobility μ can be suppressed.

To put it concretely, if the mobility correction process making use of the feedback quantity ΔV1 is carried out on pixel circuit A having a driving transistor 22 with a relatively large mobility μ, the drain-source current Ids flowing through the driving transistor 22 is much reduced from the drain-source current Ids1' to a drain-source current Ids1. If the mobility correction process making use of the feedback quantity ΔV2 is carried out on pixel circuit B having a driving transistor 22 with a relatively small mobility μ, on the other hand, the drain-source current Ids flowing through the driving transistor 22 is reduced from the drain-source current Ids2' to a drain-source current Ids2 but the reduction of the drain-source current Ids is not so large as pixel circuit A. This is because the feedback quantity ΔV2 applied to pixel circuit B is smaller than the feedback quantity ΔV1 applied to pixel circuit A. As a result, the drain-source current Ids1 flowing through the driving transistor 22 of pixel circuit A becomes approximately equal to the drain-source current Ids2 flowing through the driving transistor 22 of pixel circuit B by virtue of the mobility correction process carried out on the mobility μ.

To sum up, if pixel circuits A and B with different mobilities μ exist, the feedback quantity ΔV1 applied to pixel circuit A having a driving transistor 22 with a relatively large mobility μ is greater than the feedback quantity ΔV2 applied to pixel circuit B having a driving transistor 22 with a relatively small mobility μ. That is to say, the larger the mobility μ of a pixel circuit is, the larger the feedback quantity ΔV applied to the pixel circuit becomes and the larger the decrease in drain-source current Ids becomes. Thus, by negatively feeding the drain-source current Ids of the driving transistor 22 back to the side of the input signal voltage Vsig, the magnitudes of the drain-source currents Ids flowing through driving transistors 22 included in pixel circuits as transistors having different mobilities μ can be made uniform. As a result, variations in mobility μ can be eliminated in the mobility correction process.

FIG. 10 is a plurality of diagrams each showing relations between the input signal voltage Vsig representing a video signal and the drain-source current Ids flowing through the driving transistor 22 in the pixel (or the pixel circuit) 20 shown in FIG. 2 for a variety of cases in which neither threshold-voltage correction operation nor mobility correction operation is carried out, the threshold-voltage correction operation is carried out but the mobility correction operation is not and both the threshold-voltage correction operation as well as the mobility correction operation are carried out.

To be more specific, FIG. 10A is a diagram showing relations between the input signal voltage Vsig representing a video signal and the drain-source current Ids flowing through the driving transistor 22 in pixel circuits A and B for a case in which neither threshold-voltage correction operation nor mobility correction operation is carried out. FIG. 10B is a diagram showing relations between the input signal voltage Vsig representing a video signal and the drain-source current Ids flowing through the driving transistor 22 in pixel circuits A and B for a case in which the threshold-voltage correction operation is carried out but the mobility correction operation is not. FIG. 10C is a diagram showing relations between the input signal voltage Vsig representing a video signal and the drain-source current Ids flowing through the driving transistor 22 in pixel circuits A and B for a case in which both the threshold-voltage correction operation and the mobility correction operation are carried out. For the case in which neither threshold-voltage correction operation nor mobility correction operation is carried out, for the same input signal voltage Vsig, the difference in drain-source current Ids between pixel circuits A and B is large as shown in FIG. 9A due to variations in threshold voltage Vth and mobility μ between pixel circuits A and B.

For the case in which the threshold-voltage correction operation is carried out but the mobility correction operation is not, on the other hand, for the same input signal voltage Vsig, the difference in drain-source current Ids between pixel circuits A and B is reduced to a certain degree even though the difference still exists as shown in FIG. 10B due to mainly remaining variations in mobility μ between pixel circuits A and B.

For the case in which both the threshold-voltage correction operation and the mobility correction operation are carried out, for the same input signal voltage Vsig, the difference in drain-source current Ids between pixel circuits A and B is all but zero as shown in FIG. 10C due to few remaining variations in threshold voltage Vth and mobility μ between pixel circuits A and B. Thus, at any gradation, luminance variations among organic EL devices 21 are not generated. As a result, a displayed image with a high quality can be obtained.

Effects of the Embodiment

As described above, in the embodiment implementing the organic EL display apparatus 10 provided with correction functions such as the threshold-voltage correction function and the mobility correction function, instead of executing a threshold-voltage correction preparatory operation and a threshold-voltage correction operation for every correction-subject pixel row in the same 1H period, before the threshold-voltage correction operation is carried out on the correction-subject pixel row in the 1H period, the threshold-voltage correction preparatory operation is performed on the correction-subject pixel row prior to the 1H period in order to fix each of an electric potential Vg appearing on the gate of the driving transistor 22 and an electric potential Vs appearing on the source of the driving transistor 22 at a predetermined level. In the threshold-voltage correction preparatory operation, the electric potential Vg appearing on the gate of the driving transistor 22 and the electric potential Vs appearing on the source of the driving transistor 22 are fixed at typically the offset voltage Vofs and the low second electric potential Vini respectively. Thus, it is no longer necessary to allocate sufficient time of the 1H period provided for the correction-subject pixel row to the threshold-voltage correction preparatory operation as a threshold-voltage correction preparation period. As a result, the threshold-voltage correction period and the mobility correction period can be prolonged totally by the threshold-voltage correction preparation period of the threshold-voltage correction preparatory operation.

Therefore, since it is possible to allocate sufficient time to each of the threshold-voltage correction operation and the mobility correction operation as a threshold-voltage correction period and a mobility correction period respectively, it is also possible to assure that the threshold-voltage correction operation and the mobility correction operation can each be carried out with a high degree of reliability. Accordingly, since variations of the characteristics of the driving transistor 22 from pixel to pixel and deteriorations of the organic EL device 21 with the lapse of time can be suppressed effectively, a high-quality uniform image with neither unevenness nor shading can be displayed. As described earlier, the characteristics of the driving transistor 22 include the threshold voltage Vth and mobility μ of the driving transistor 22. Also as explained before, the variations in transistor characteristics are attributed to variations of the process to fabricate the driving transistor 22 and characteristic changes with the lapse of time.

In particular, a threshold-voltage correction preparatory operation performed on a correction-subject pixel row prior to an 1H period in which a threshold-voltage correction operation is carried out on the correction-subject pixel row is an operation that is optimal for an operation to drive a display apparatus described as follows.

There is a rising demand for a high-resolution display apparatus employed in mobile electronic equipment such as a hand phone for displaying for example a fine map and characters. In addition, as the resolution of the display apparatus is raised, the horizontal scan period having a length of 1H is shortened. Thus, it becomes difficult to allocate sufficient time of the horizontal scan period having a length of 1H to each of the threshold-voltage correction operation and the mobility correction operation as a threshold-voltage correction period and a mobility correction period respectively.

As described above, the higher resolution of an organic EL display apparatus entails a larger number of pixel circuits and a short horizontal scan period having a length of 1H in comparison with the horizontal scan period for the resolution in the related art in the related art. Nevertheless, if a driving method is applied to such an organic EL display apparatus as a method whereby a threshold-voltage correction preparatory operation is performed on a correction-subject pixel row prior to an 1H period allocated to a threshold-voltage correction operation carried out on the correction-subject pixel row, it is possible to allocate sufficient time to each of the threshold-voltage correction operation and the mobility correction operation as a threshold-voltage correction period and a mobility correction period respectively. It is thus possible to assure that the threshold-voltage correction operation and the mobility correction operation can each be carried out with a high degree of reliability. Accordingly, since variations of the characteristics of the driving transistor 22 from pixel to pixel and deteriorations of the organic EL device 21 with the lapse of time can be suppressed effectively, an image having a high quality can be displayed.

In addition, in order to reduce the cost, even an organic EL display apparatus employing pixel circuits 20 each including a driving transistor having a small mobility μ also adopts a method whereby a threshold-voltage correction preparatory operation is performed on a correction-subject pixel row prior to an 1H period allocated to a threshold-voltage correction operation carried out on the correction-subject pixel row so that it is possible to allocate sufficient time to each of the threshold-voltage correction operation and the mobility correction operation as a threshold-voltage correction period and a mobility correction period respectively. It is thus possible to assure that the threshold-voltage correction operation and the mobility correction operation can each be carried out with a high degree of reliability. Accordingly, since variations of the characteristics of the driving transistor 22 from pixel to pixel and deteriorations of the organic EL device 21 with the lapse of time can be suppressed effectively, an image having a high quality can be displayed. An example of the transistor having a small mobility μ is a transistor made of a-Si (amorphous silicon).

<Organic EL Display Apparatus Adopting a Selector Driving Method>

The organic EL display apparatus 10 according to the embodiment described above as an example has a configuration in which the horizontal driving circuit 60 is implemented on the display panel 70. However, it is also possible to design an organic EL display apparatus 10 into a configuration in which the horizontal driving circuit 60 is provided externally to the display panel 70 and supplies video signals to the signal lines 33 (that is, signal lines 33-1 to **33-*n*) on the display panel 70** through external wires.

In the case of the configuration in which a video signal is received from a source external to the display panel 70, the external wires and the signal lines 33 are wired separately for each of the R (red), G (green) and B (blue) colors to result in the so-called Full HD (High Definition) having a resolution of 1,920×1,080. With such a high resolution, however, 5,760 (=1,920×3) external wires are required. That is to say, the number of wires each used as an external wire is large.

In order to reduce the number of wires each used as an external wire, the configuration adopts a selector driving method whereby a plurality of signal lines 33 provided on the display panel 70 as a group or a set are assigned to one output of a driver IC serving as the horizontal driving circuit 60 external to the display panel 70. Then, the signal lines 33 assigned to the output are selected sequentially one line after another on a time-division basis and video signals generated at different levels along the time axis as the output of the driver IC are allocated and supplied to the set of signal lines 33 in an operation to drive the signal lines 33. This selector driving method is also referred to as a time-division driving method.

To put it concretely, in accordance with the selector driving method, each output of the IC driver serving as the horizontal driving circuit 60 is assigned to x signal lines 33 provided on the display panel 70 where x is integer equal to or greater than 2. Then, the x signal lines 33 assigned to an output of the IC driver are selected sequentially one line after another during x time divisions allocated to the signal lines 33 respectively. By adopting the selector driving method, the number of outputs of the IC driver and the number of wires each serving as an external wire can each be reduced to 1/x times the total number of signal lines 33.

Figure 11:
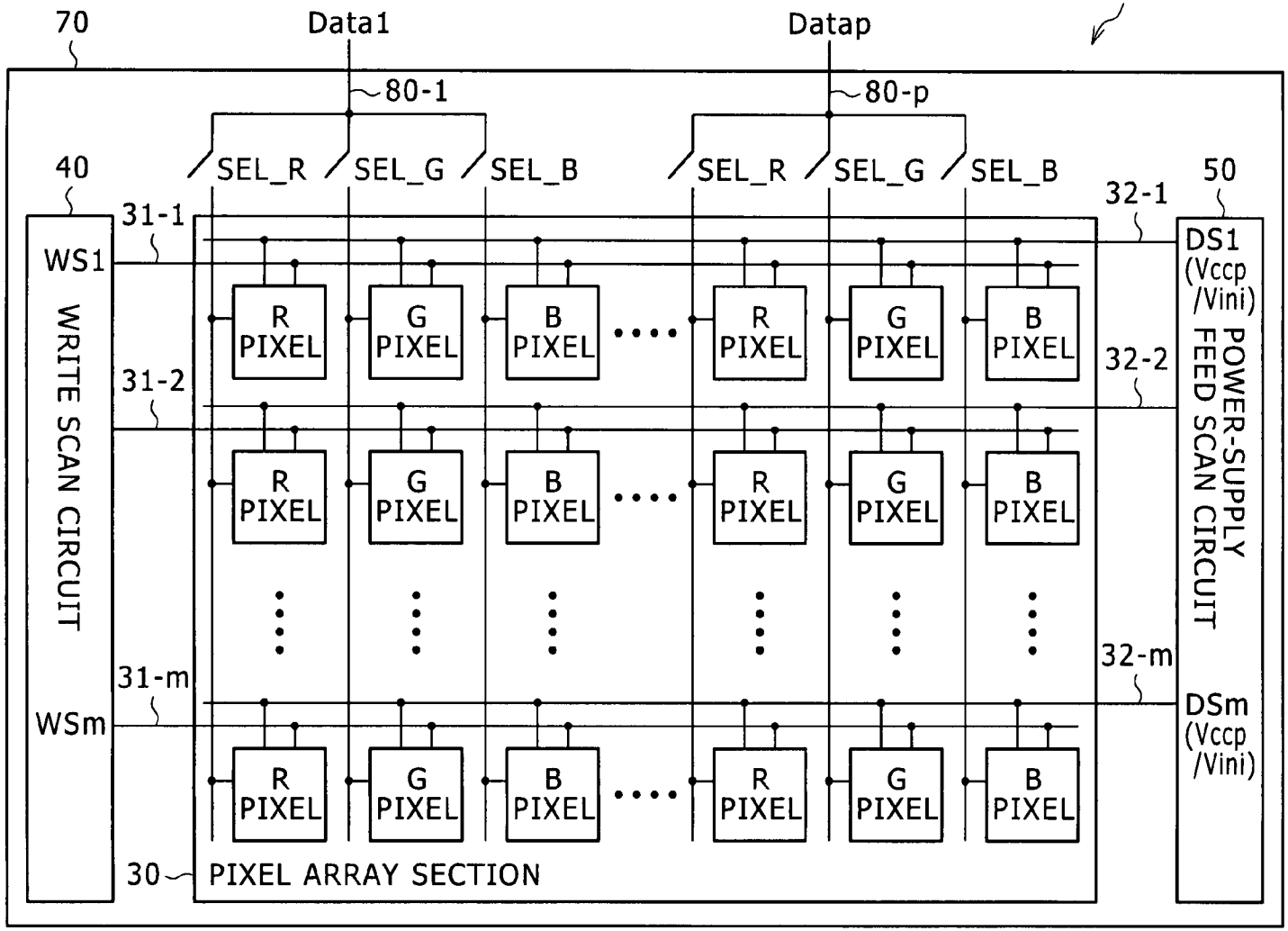
FIG. 11 is a system diagram roughly showing the configuration of an organic EL display apparatus adopting a selector driving method.

A typical configuration adopting the selector driving method is shown in FIG. 11. As shown in the figure, x (=3) signal lines 33 corresponding to the three R (Red), G (Green) and B (Blue) colors respectively form a group. Video signals Data1, Data2, . . . and Datap are supplied to group 1, group 2, . . . and group p respectively along the time axis within a 1H period. Selector switches SEL_R, SEL_G and SEL_B are provided for the column of R pixel circuits, the column of G pixel circuits and the column of B pixel circuits respectively in each of the groups. The selector switches SEL_R, SEL_G and SEL_B are turned on sequentially from column to column in each of the groups in order to supply the video signals Data1, Data2, . . . and Datap to group 1, group 2, . . . and group p respectively. This configuration offers a merit that the number of outputs of the IC driver or the number of wires each serving as one of external wires 80-1 to **80-*p* can each be reduced to 1/x times the total number of signal lines 33-1 to 33-*n*. That is to say, p=(1/x)×n where notation p denotes the number of outputs of the IC driver or the number of wires each serving as one of external wires 80-1 to 80-*p* whereas notation n denotes the total number of signal lines 33-1 to 33-*n***.

Figure 12:
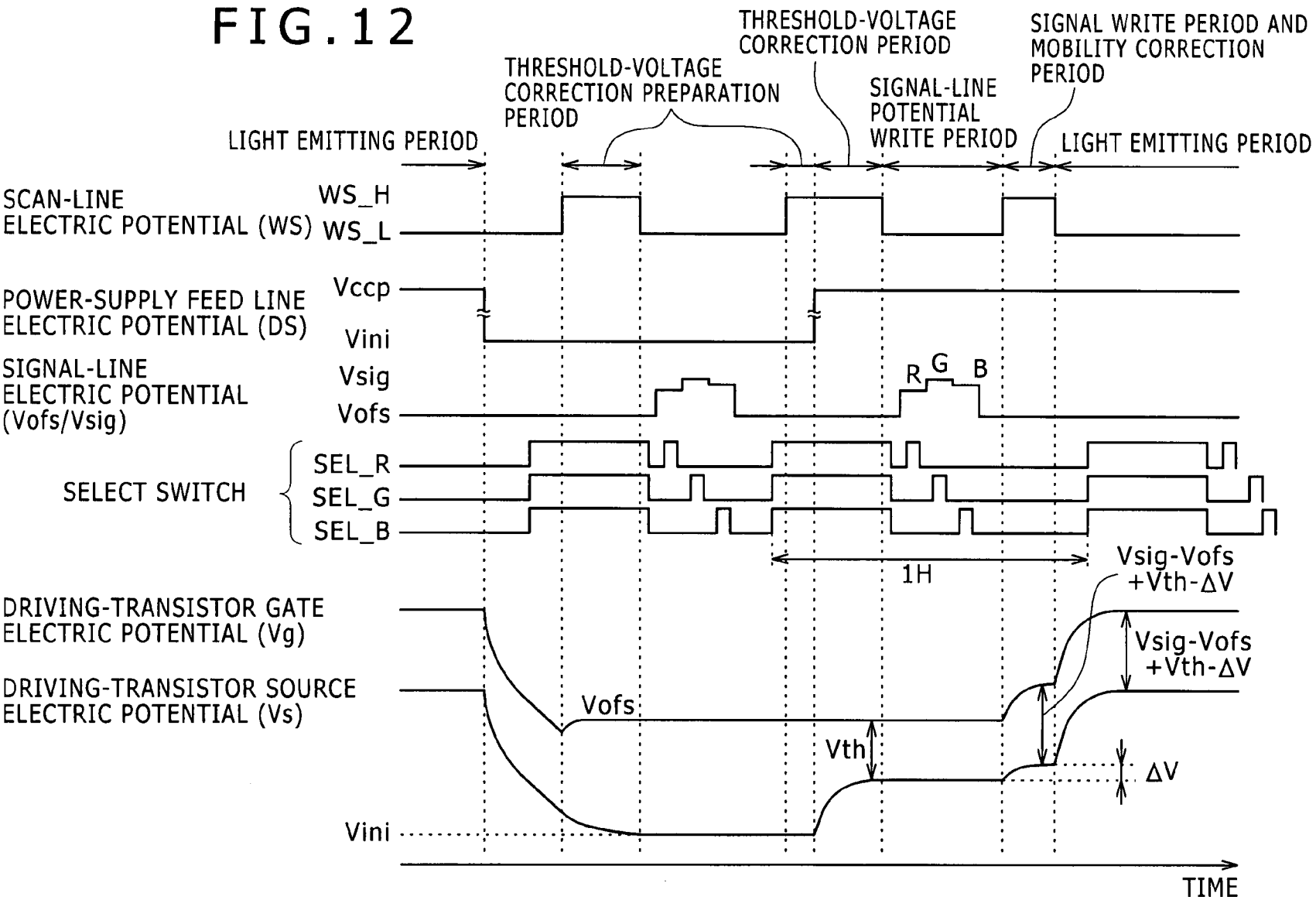
FIG. 12 is an explanatory diagram showing timing charts of operations carried out by the organic EL display apparatus adopting the selector driving method.

In the case of an organic EL display apparatus adopting the selector driving method (or the time-division driving method), however, it is necessary to provide a signal-line electric-potential write period for asserting different input signal voltages Vsig representing the R, G and B video signals on every three signal lines 33 respectively of the signal lines 33-1 to **33-*n* through the selector switches SEL_R, SEL_G and SEL_B as shown in timing charts of FIG. 12**. Thus, it becomes even more difficult to allocate sufficient time to each of the threshold-voltage correction operation and the mobility correction operation as a threshold-voltage correction period and a mobility correction period respectively.

As described above, in the case of an organic EL display apparatus 10' adopting the selector driving method whereby typically R, G and B video signals are written into three pixel circuits (i.e., R, G and B pixel circuits) respectively during a 1H period, it is necessary to provide a signal-line electric-potential write period for asserting the input signal voltages Vsig representing the R, G and B video signals on every three signal lines 33 respectively of the signal lines 33-1 to **33-*n*. Nevertheless, if the organic EL display apparatus 10' adopts the method whereby a threshold-voltage correction preparatory operation is performed on a correction-subject pixel row prior to an 1H period allocated to a threshold-voltage correction operation carried out on the correction-subject pixel row, it is possible to allocate sufficient time to the threshold-voltage correction operation and the mobility correction operation as a threshold-voltage correction period and a mobility correction period respectively. Accordingly, since variations of the characteristics of the driving transistor 22 from pixel to pixel and deteriorations of the organic EL device 21** with the lapse of time can be suppressed effectively, an image having a high quality can be displayed.

Modifications of the Embodiment

The embodiment described above implements a typical organic EL display apparatus 10 provided with both a threshold-voltage correction function and a mobility correction function. However, the organic EL display apparatus can be provided with only the threshold-voltage correction function without the mobility correction function. Even in the case of such an organic EL display apparatus, the threshold-voltage correction preparatory operation can be performed on a correction-subject pixel row prior to an 1H period allocated to a threshold-voltage correction operation carried out on the correction-subject pixel row so that it is possible to allocate long time of the 1H period to the threshold-voltage correction operation as a threshold-voltage correction period in comparison with the case in which a threshold-voltage correction preparatory operation is performed on a correction-subject pixel row in the same 1H period as a threshold-voltage correction preparatory operation carried out on the same correction-subject pixel row. Thus, the threshold-voltage correction operation can be carried out with a high degree of reliability.

In addition, the embodiment described above implements a typical organic EL display apparatus 10 having a configuration in which each pixel circuit 20 employs two transistors, i.e. the write transistor 23 and the driving transistor 22, whereas a mobility correction operation is carried out in the same period as an operation to write the input signal voltage Vsig into the pixel circuit 20. It is to be noted, however, that the scope of the present invention is by no means limited to this embodiment. For example, as disclosed in patent reference 1, the present invention can also be applied to an organic EL display apparatus designed into a configuration in which each pixel circuit 20 is further provided with a switching transistor connected in series to the driving transistor 22 as a transistor for controlling the light emitting period/the no-light emitting period of the organic EL device 21 and for carrying out a mobility correction operation prior to the operation to write the input signal voltage Vsig into the pixel circuit 20.

If the mobility correction operation is carried out in the same period as the operation to write the input signal voltage Vsig into the pixel circuit 20 as is the case with the configuration of the organic EL display apparatus 10 according to the embodiment, however, it is not necessary to allocate time to the signal write operation as a signal write period separated from the mobility correction period. Thus, the embodiment described above offers a merit that it is possible to allocate sufficiently long time to each of the threshold-voltage correction operation and the mobility correction operation as a threshold-voltage correction period and a mobility correction period respectively.

In addition, the embodiment described above implements a typical organic EL display apparatus 10 employing organic EL devices each serving as the electro-optical device of a pixel circuit 20. It is to be noted, however, that the scope of the present invention is by no means limited to this embodiment. That is to say, the present invention can also be applied to a general display apparatus employing any current-driven electro-optical devices (or any current-driven light emitting devices) as long as the electro-optical devices each generates a light beam with the luminance thereof determined by a driving current flowing through the device.

[Typical Applications]

The display apparatus according to the embodiments described above are typically applied to various kinds of electronic equipment shown in FIGS. 13 to 17. To be more specific, the display apparatus can be used as the display apparatus employed in electronic equipment used in all fields as equipment for displaying a video signal supplied to the equipment or a video signal generated in the equipment on the display apparatus as an image or a video. Examples of the electronic equipment are a digital camera, a notebook personal computer, a portable terminal such as a hand phone and a video camera.

It is to be noted that the display apparatuses according to the present invention include a display apparatus having a sealed module configuration. In a typical sealed module configuration, a display module pasted to an opposed member such as a piece of transparent glass corresponds to the pixel array section 30. On the opposed transparent member, it is also possible to provide a color filter, a protection film, a light shielding film described earlier and another component. It is also worth noting that, on the display module, it is possible to provide a circuit or an FPC (Flexible Printed Circuit). The circuit is used for inputting a signal from an external source and supplying the signal to the pixel array section 30 and used for outputting a signal received from the pixel array section 30 to an external target.

Figure 13:
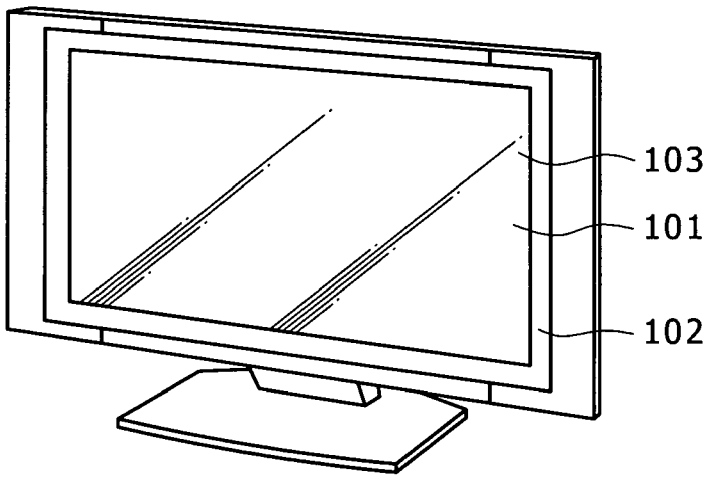
FIG. 13 is a diagram showing a perspective view of a TV to which an embodiment according to the present invention is applied.

FIG. 13 is a diagram showing a perspective view of a TV to which an embodiment of the present invention is applied. As shown in the figure, the TV serving as a typical application of the embodiment employs sections such as a video display screen 101 including a front panel 102 and a filter glass 103. In the TV, the display apparatus according to the present invention is used as the video display screen 101.

Figure 14A:
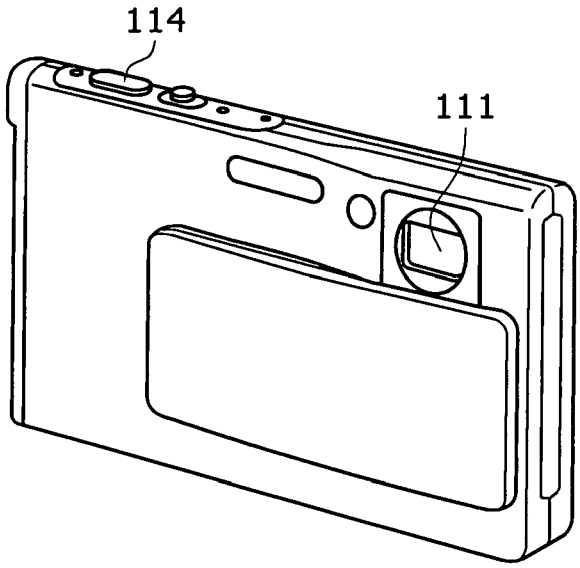
FIG. 14A is a diagram showing a perspective view of the front side of the digital camera to which an embodiment according to the present invention is applied.
Figure 14B:
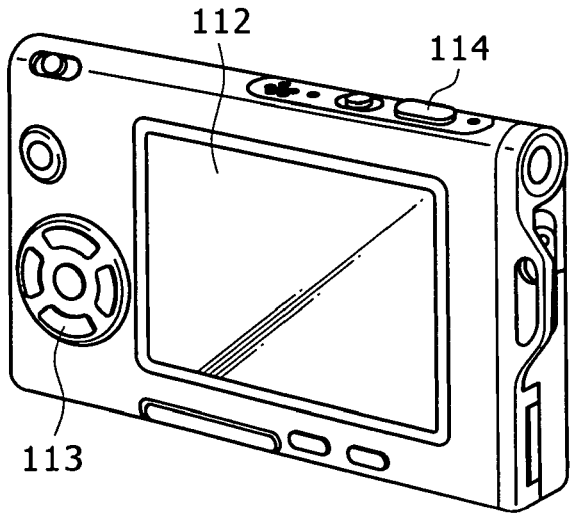
FIG. 14B is a diagram showing a perspective view of the rear side of the digital camera to which an embodiment according to the present invention is applied.

FIGS. 14A and 14B are diagrams showing perspective views of a digital camera to which an embodiment of the present invention is applied. To be more specific, FIG. 14A is a diagram showing a perspective view of the front side whereas FIG. 14B is a diagram showing a perspective view of the rear side. As shown in the figure, the digital camera according to the embodiment employs sections such as a light emitting section 111, a display section 112, a menu switch 113 and a shutter button 114. In the digital camera, the display apparatus according to the present invention is used as the display section 112.

Figure 15:
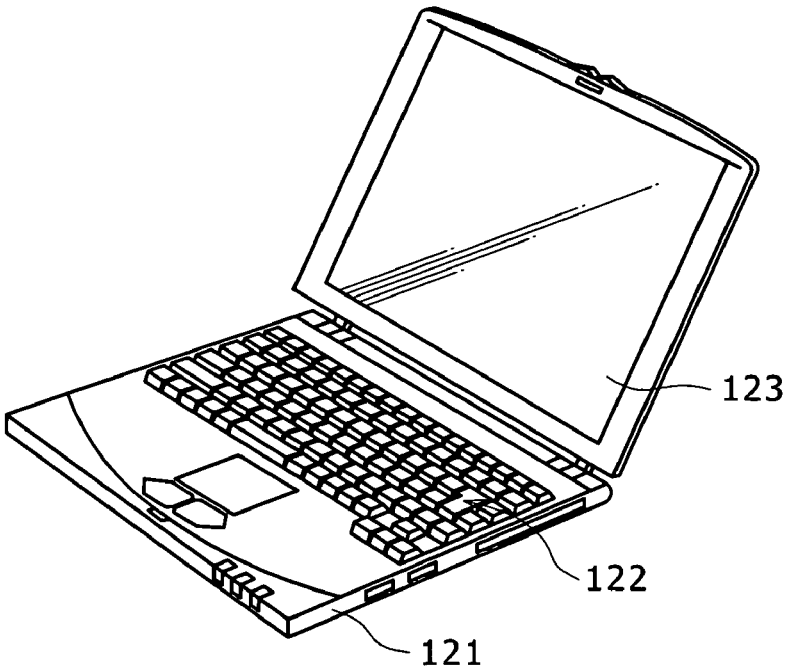
FIG. 15 is a diagram showing a perspective view of a notebook personal computer to which an embodiment according to the present invention is applied.

FIG. 15 is a diagram showing a perspective view of a notebook personal computer to which an embodiment of the present invention is applied. As shown in the figure, the main body 121 of the notebook personal computer according to the embodiment includes sections such as a keyboard 122 and a display section 123. The keyboard 122 is a section to be operated by the user to enter an input such as a string of characters whereas the display section 123 is a section for displaying an image. In the notebook personal computer, the display apparatus according to the present invention is used as the display section 123.

Figure 16:
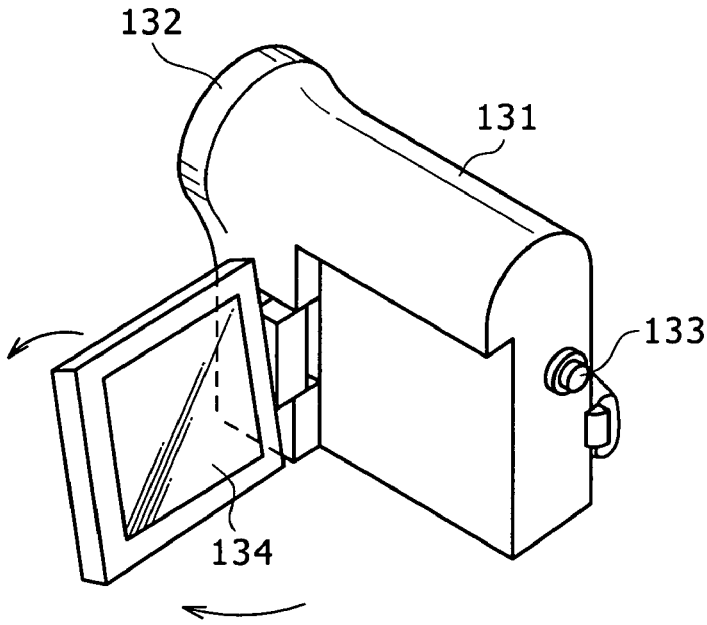
FIG. 16 is a diagram showing a perspective view of a video camera to which an embodiment according to the present invention is applied.

FIG. 16 is a diagram showing a perspective view of a video camera to which an embodiment of the present invention is applied. As shown in the figure, the main body 131 of the video camera according to the embodiment includes sections such as a lens 132, a start/stop switch 133 and a display section 134. In the video camera, the display apparatus according to the present invention is used as the display section 134.

Figure 17A:
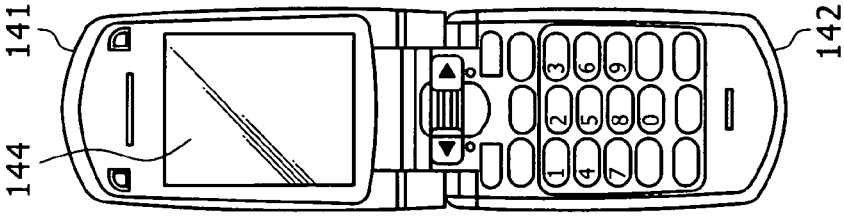
FIG. 17A is a diagram showing the front face of a hand phone serving as the portable terminal to which an embodiment according to the present invention is applied.
Figure 17B:
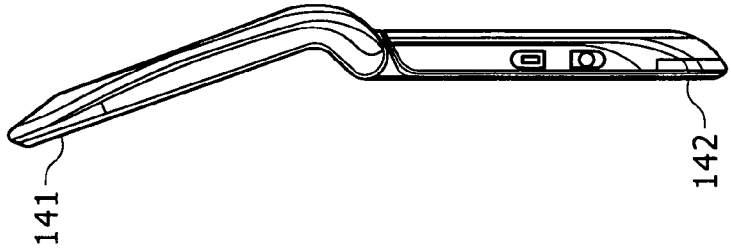
FIG. 17B is a diagram showing a side face of the hand phone to which an embodiment according to the present invention is applied.
Figure 17C:
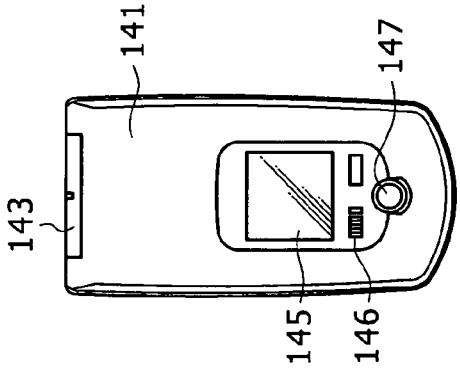
FIG. 17C is a diagram showing the front face of the hand phone in a folded state to which an embodiment according to the present invention is applied.
Figure 17D:
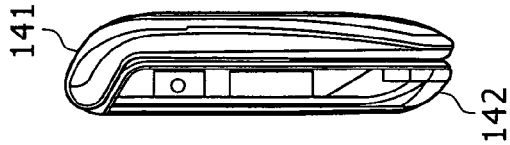
FIG. 17D is a diagram showing the left-side face of the hand phone in the folded state to which an embodiment according to the present invention is applied.
Figure 17E:
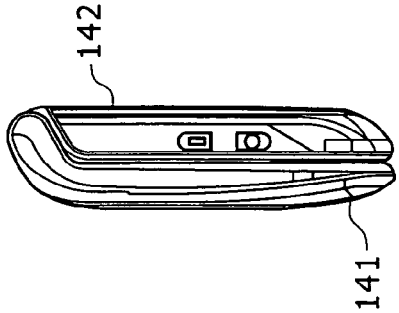
FIG. 17E is a diagram showing the right-side face of the hand phone in the folded state to which an embodiment according to the present invention is applied.
Figure 17F:
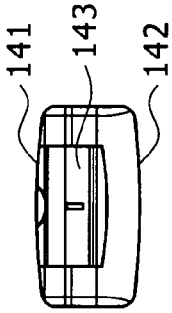
FIG. 17F is a diagram showing the top of the hand phone in the folded state to which an embodiment according to the present invention is applied.
Figure 17G:
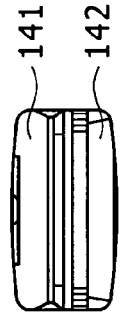
FIG. 17G is a diagram showing the bottom of the hand phone in the folded state to which an embodiment according to the present invention is applied.

FIGS. 17A to 17G are diagrams showing perspective views of a portable terminal to which an embodiment of the present invention is applied. An example of the portable terminal is a hand phone. To be more specific, FIG. 17A is a diagram showing the front face of the hand phone whereas FIG. 17B is a diagram showing a side face of the phone. FIG. 17C is a diagram showing the front face of the hand phone in a folded state whereas FIG. 17D is a diagram showing the left-side face of the phone in the folded state. FIG. 17E is a diagram showing the right-side face of the hand phone in the folded state whereas FIG. 17F is a diagram showing the top of the phone in the folded state. FIG. 17G is a diagram showing the bottom of the hand phone in the folded state. As shown in the figure, the hand phone according to the embodiment employs sections such as an upper chassis 141, a lower chassis 142, a link section (or a hinge section) 143, a display section 144, a sub-display section 145, a picture light 146 and a camera 147. In the hand phone, the display apparatus according to the present invention is used as the display section 144 and the sub-display section 145.

In addition, it should be understood by those skilled in the art that a variety of modifications, combinations, sub-combinations and alterations may occur, depending on design requirements and other factors insofar as they are within the scope of the appended claims or the equivalents thereof.

What is claimed is:

1. A display apparatus comprising:

a pixel array section including pixel circuits laid out to form a matrix as pixel circuits each having an electro-optical device, a write transistor configured to carry out a voltage storing process to sample a video signal that is provided from a signal line, and to store said sampled video signal into said pixel circuit, a holding capacitor configured to hold said sampled video signal stored in said pixel circuit by said write transistor, and a driving transistor configured to drive said electro-optical device on the basis of said video signal held by said voltage holding capacitor; and a driving circuit configured to carry out a selective scan operation on said pixel circuits in said pixel array section in row units, a preparatory operation to set electric potentials on a gate and a source of said driving transistor during a non-light-emitting period, and a threshold-voltage correction operation to correct variations of the threshold voltage of every driving transistor for each pixel row selected in said selective scan operation:

wherein, before said driving circuit carries out the threshold-voltage correction operation on a pixel row in a horizontal scan period, said driving circuit performs the preparatory operation on said pixel row in order to set the electric potential on the gate of said driving transistor according to a first reference voltage provided from the signal line through the write transistor and to set the electric potential on the source of said driving transistor according to a second reference voltage provided through the driving transistor.

2. The display apparatus according to claim 1 wherein said driving circuit carries out a mobility correction operation on a pixel row in order to compensate for variations of the mobility of each driving transistor employed in said pixel row in the same horizontal scan period as said threshold-voltage correction operation carried out on said pixel row after execution of said threshold-voltage correction operation.

3. The display apparatus according to claim 2 wherein said driving circuit carries out said mobility correction operation in a write period during which said write transistor performs said voltage storing process to store said sampled video signal into said pixel circuit.

4. The display apparatus according to claim 1, wherein the second reference potential is provided from a power supply line through the driving transistor, the second reference potential differing from a voltage supply level provided from the power supply line for a light emitting period of the electro-optical device.

5. A driving method adopted by a display apparatus comprising—a pixel array section including pixel circuits laid out to from a matrix as pixel circuits each having an electro-optical device, a write transistor configured to carry out a voltage storing process to sample a video signal that is provided from a signal line and to store said sampled video signal into said pixel circuit, a holding capacitor configured to hold said sampled video signal stored in said pixel circuit by said write transistor, a driving transistor configured to drive said electro-optical device on the basis of said video signal held by said voltage holding capacitor, and a driving circuit, the method comprising:

performing a selective scan operation on said pixel circuits in said pixel array section in row units, performing a preparatory operation to set electric potentials on a gate and a source of said driving transistor during a non-light-emitting period, and performing a threshold-voltage correction operation to correct variations of the threshold voltage of every driving transistor for each pixel row selected in said selective scan operation, wherein, before the threshold-voltage correction operation is performed on said pixel row in a horizontal scan period, the preparatory operation is performed on said pixel row in order to set the electric potential on the gate of said driving transistor according to a first reference voltage provided from the signal line through the write transistor and to set the electric potential on the source of said driving transistor at a predetermined level according to a second reference voltage provided through the driving transistor.

6. The driving method according to claim 5, further comprising:

performing a mobility correction operation on a pixel row in order to compensate for variations of the mobility of each driving transistor employed in said pixel row in the same horizontal scan period as said threshold-voltage correction operation carried out on said pixel row after execution of said threshold-voltage correction operation.

7. The driving method according to claim 6, wherein said mobility correction operation is performed in a write period during which said write transistor performs said voltage storing process to store said sampled video signal into said pixel circuit.

8. The driving method according to claim 5, wherein the second reference potential is provided from a power supply line through the driving transistor, the second reference potential differing from a voltage supply level provided from the power supply line for a light emitting period of the electro-optical device.

9. An electronic equipment employing a display apparatus comprising:

a pixel array section including pixel circuits laid out to from a matrix as pixel circuits each having an electro-optical device, a write transistor for carrying out a voltage storing process to sample a video signal that is provided from a signal line, and to store said sampled video signal into said pixel circuit, a holding capacitor for holding said sampled video signal stored in said pixel circuit by said write transistor, and a driving transistor for driving said electro-optical device on the basis of said video signal held by said voltage holding capacitor; and a driving circuit for carrying out a selective scan operation on said pixel circuits in said pixel array section in row units, a preparatory operation to set electric potentials on a gate and a source of said driving transistor during a non-light-emitting period, and a threshold-voltage correction operation to correct variations of the threshold voltage of every driving transistor for each pixel row selected in said selective scan operation wherein, before said threshold-voltage correction operation is carried out on said pixel row in a horizontal scan period, the preparatory operation is carried out on said pixel row in order to set the electric potential on the gate of said driving transistor according to a first reference voltage provided from the signal line through the write transistor and to set the electric potential on the source of said driving transistor according to a second reference voltage provided through the driving transistor.

10. The electronic apparatus according to claim 9, wherein said driving circuit carries out a mobility correction operation on a pixel row in order to compensate for variations of the mobility of each driving transistor employed in said pixel row in the same horizontal scan period as said threshold-voltage correction operation carried out on said pixel row after execution of said threshold-voltage correction operation.

11. The electronic apparatus according to claim 10, wherein said driving circuit carries out said mobility correction operation in a write period during which said write transistor performs said voltage storing process to store said sampled video signal into said pixel circuit.

12. The electronic apparatus according to claim 9, wherein the second reference potential is provided from a power supply line through the driving transistor, the second reference potential differing from a voltage supply level provided from the power supply line for a light emitting period of the electro-optical device.

* * * * *